US010176663B2

(12) United States Patent
King et al.

(10) Patent No.: US 10,176,663 B2
(45) Date of Patent: Jan. 8, 2019

(54) SYSTEM AND METHOD FOR LOADING A DISPENSING CASSETTE USEFUL IN A SYSTEM FOR DISPENSING PRE-PACKAGED PHARMACEUTICALS

(71) Applicant: spencer Health Solutions, LLC, Durham, NC (US)

(72) Inventors: Michael L. King, Durham, NC (US); Michael J. Kiplinger, Raleigh, NC (US); John Michael Burton, Jr., Durham, NC (US); Jeffrey J. Schedel, Apex, NC (US); Sasha Morris, Cary, NC (US); Jacob White, Holly Springs, NC (US); Jeremy Scott Bridges, Apex, NC (US)

(73) Assignee: spencer Health Solutions, LLC, Durham, NC (US)

( * ) Notice: Subject to any disclaimer, the term of this patent is extended or adjusted under 35 U.S.C. 154(b) by 0 days.

(21) Appl. No.: 15/639,167

(22) Filed: Jun. 30, 2017

(65) Prior Publication Data

US 2018/0012439 A1 Jan. 11, 2018

Related U.S. Application Data

(60) Provisional application No. 62/493,495, filed on Jul. 6, 2016.

(51) Int. Cl.
*G07F 17/00* (2006.01)
*A61J 7/00* (2006.01)
(Continued)

(52) U.S. Cl.
CPC ..... *G07F 17/0092* (2013.01); *A61J 1/00* (2013.01); *A61J 7/0076* (2013.01); *A61J 7/0084* (2013.01);
(Continued)

(58) Field of Classification Search
CPC ..... G07F 11/68; G07F 17/0092; A61J 1/00; A61J 1/03; A61J 7/0076; A61J 7/04;
(Continued)

(56) References Cited

U.S. PATENT DOCUMENTS 2,587,928 A 3/1952 Tuck et al.
2,984,397 A 5/1961 Gillam
(Continued)

FOREIGN PATENT DOCUMENTS

WO WO 2013/013108 A2 1/2013

OTHER PUBLICATIONS

Notification of Transmittal of the International Search Report and the Written Opinion of the Internationai Searching Authority, or the Declaration, PCT/US2016/035804, dated Sep. 12, 2016, 14 pages.
(Continued)

*Primary Examiner* — Michael Collins
(74) *Attorney, Agent, or Firm* — Myers Bigel, P.A.

(57) ABSTRACT

The present specification describes a system for automatically preparing medication cartridges for use in a pharmaceutical dispensing system. The system includes a spooler device that winds a strip of medicine pouches around a cylinder in a cartridge frame. When the cartridge has been loaded with the medication strip, the system validates that there is a match between the information on the cartridge cover and the mediation pouches.

17 Claims, 24 Drawing Sheets

(51) Int. Cl.

| | |
|---|---|
| ***G07F 11/68*** | (2006.01) |
| ***A61J 7/04*** | (2006.01) |
| ***A61J 1/03*** | (2006.01) |
| ***A61J 1/00*** | (2006.01) |

(52) U.S. Cl.
CPC ..... *A61J 7/04* (2013.01); *A61J 7/0418* (2015.05); *A61J 7/0454* (2015.05); *A61J 7/0481* (2013.01); *G07F 11/68* (2013.01); *A61J 1/03* (2013.01); *A61J 2200/30* (2013.01); *A61J 2205/10* (2013.01); *A61J 2205/60* (2013.01)

(58) Field of Classification Search
CPC ..... A61J 7/0084; A61J 7/0481; A61J 7/0418; A61J 7/0454; A61J 2200/30; A61J 2205/10; A61J 2205/60
USPC ..... 700/231–244
See application file for complete search history.

(56) References Cited

U.S. PATENT DOCUMENTS

| | | | | |
|---|---|---|---|---|
| 4,162,739 | A | 7/1979 | Nelson | |
| 4,361,408 | A | 11/1982 | Wirtschafter | |
| 4,733,797 | A | 3/1988 | Haber | |
| 5,246,299 | A | 9/1993 | Kitsuki et al. | |
| 5,630,347 | A | 5/1997 | Elvio | |
| 5,671,592 | A | 9/1997 | Yuyama et al. | |
| 6,085,936 | A | 7/2000 | Friar et al. | |
| 6,202,385 | B1 | 3/2001 | Kim | |
| 6,533,204 | B2 | 3/2003 | Ishihara et al. | |
| 7,944,342 | B2 | 5/2011 | Sekura | |
| 7,963,201 | B2 | 6/2011 | Willoughby | |
| 8,060,246 | B2 | 11/2011 | Berg | |
| 8,135,497 | B2 | 3/2012 | Joslyn | |
| 8,196,774 | B1 * | 6/2012 | Clarke | A61J 7/0409 221/13 |
| 8,311,853 | B1 | 11/2012 | Pankow et al. | |
| 8,662,347 | B2 | 3/2014 | Coggins et al. | |
| 9,351,907 | B2 * | 5/2016 | Luoma | A61J 1/035 |
| 9,361,431 | B2 * | 6/2016 | Fauci | G06F 19/3462 |
| 9,387,153 | B1 * | 7/2016 | Mazur | A61J 7/0069 |
| 9,719,628 | B2 | 8/2017 | Sternberg | |
| 2001/0021074 | A1 | 9/2001 | Marquiss et al. | |
| 2005/0049747 | A1 | 3/2005 | Willoughby et al. | |
| 2008/0119958 | A1 * | 5/2008 | Bear | A61J 7/0481 700/244 |
| 2013/0066463 | A1 * | 3/2013 | Luoma | A61J 1/035 700/232 |
| 2013/0282163 | A1 | 10/2013 | Brown | |
| 2014/0114471 | A1 | 4/2014 | Kim | |
| 2014/0139998 | A1 | 5/2014 | Tasi et al. | |
| 2014/0346184 | A1 * | 11/2014 | Bae | A61J 7/0076 221/1 |
| 2016/0355322 | A1 | 12/2016 | Burton, Jr. et al. | |

OTHER PUBLICATIONS

Notification of Transmittal of the International Search Report and the Written Opinion of the International Searching Authority, or the Declaration, PCT/US2017/040659, dated Sep. 20, 2017.

Notification of Transmittal of the International Search Report and the Written Opinion of the Internationai Searching Authority, or the Declaration for corresponding PCT Application No. PCT/US2017/052412, dated Jan. 9, 2018.

* cited by examiner

SYSTEM AND METHOD FOR LOADING A DISPENSING CASSETTE USEFUL IN A SYSTEM FOR DISPENSING PRE-PACKAGED PHARMACEUTICALS

RELATED APPLICATION

The present application claims priority from and the benefit of U.S. Provisional Patent Application No. 62/493,495, filed Jul. 6, 2016, the disclosure of which is hereby incorporated by reference herein in its entirety.

FIELD

The present invention relates generally to devices for preparing items to be dispensed and, more specifically, to systems and methods for preparing pharmaceutical packages to be dispensed from systems that assist patients in taking prescription medication, in accordance with a desired regimen prescribed by a physician.

BACKGROUND

Even with the present day advances in medicines and healthcare, people, especially senior citizens and disabled persons, face a number of challenges in taking care of their health at home. Typically there is little assistance for the 'home patient' in managing multiple prescriptions and inventories of medicines. According to some estimates, the average senior person is prescribed up to thirteen different oral medications that must be taken correctly at different times each day. These medications are typically delivered in bulk supply and must be sorted, managed, and then taken correctly by the individual, leading to numerous errors and omissions, including failing to take the medications at the prescribed time, taking the medications at the wrong time and/or in the incorrect amount, misusing the medications, dangerously combining the medications with other medications, under-using the medications, or over-using the medications, collectively referred to "non-compliance".

The costs associated with such non-compliance are higher than the costs associated with a number of major illnesses. Studies have shown that 10% of admissions to regular hospitals in the United States are due to non-compliance, at a cost of $15 billion a year, and 30% of hospital admissions for people over the age of 65 are directly caused by non-compliance. Non-compliance causes 125,000 deaths per year—twice as many as are caused by auto accidents. Twenty-three percent to forty percent of nursing home admissions are due to noncompliance and inability to take medications at home unsupervised. According to estimates, nearly half of all prescriptions, are taken incorrectly, contributing to prolonged or additional illness. People who miss doses need 3 times as many doctor visits as others and face an average of $2,000 more in medical costs per year.

The fact that the aging population continues to grow, combined with the steady increase in the average number of medications prescribed per person, indicates that these issues will continue to compound along with the associated costs.

In order to ensure that medications are taken at the proper time, a variety of devices, such as the ones disclosed in U.S. Pat. Nos. 4,361,408 and 7,944,342, have been devised to generate audible and/or visible prompting or alarm signals that remind a patient or his caretaker to administer the correct dosages at the correct time. Various dispensing devices have also been developed to help patients adhere to their medication protocols or regimens. Examples of such devices are provided in U.S. Pat. Nos. 8,060,246 and 8,196,774.

U.S. Patent Application Nos. 62/171,646, 62/263,345, 62/292,713, and Ser. No. 15/172,696, which are incorporated herein, by reference, in their entirety, disclose a simple yet efficient system that not only reminds a patient to take medication according to their prescribed schedule, but also provides the required medicines to the patient in a simple, convenient and reliable manner. In the example system, medications are provided to the patient in pouches which are dispensed from a strip of said pouches wound in a cartridge.

There may be a need for a system to efficiently and accurately load the strip of medication pouches in the dispensing cartridge so that the cartridge is ready to be used in a dispenser.

BRIEF DESCRIPTION OF THE DRAWINGS

These and other features and advantages of the present invention will be appreciated, as they become better understood by reference to the following detailed description when considered in connection with the accompanying drawings, wherein.

DETAILED DESCRIPTION

Figure 1:
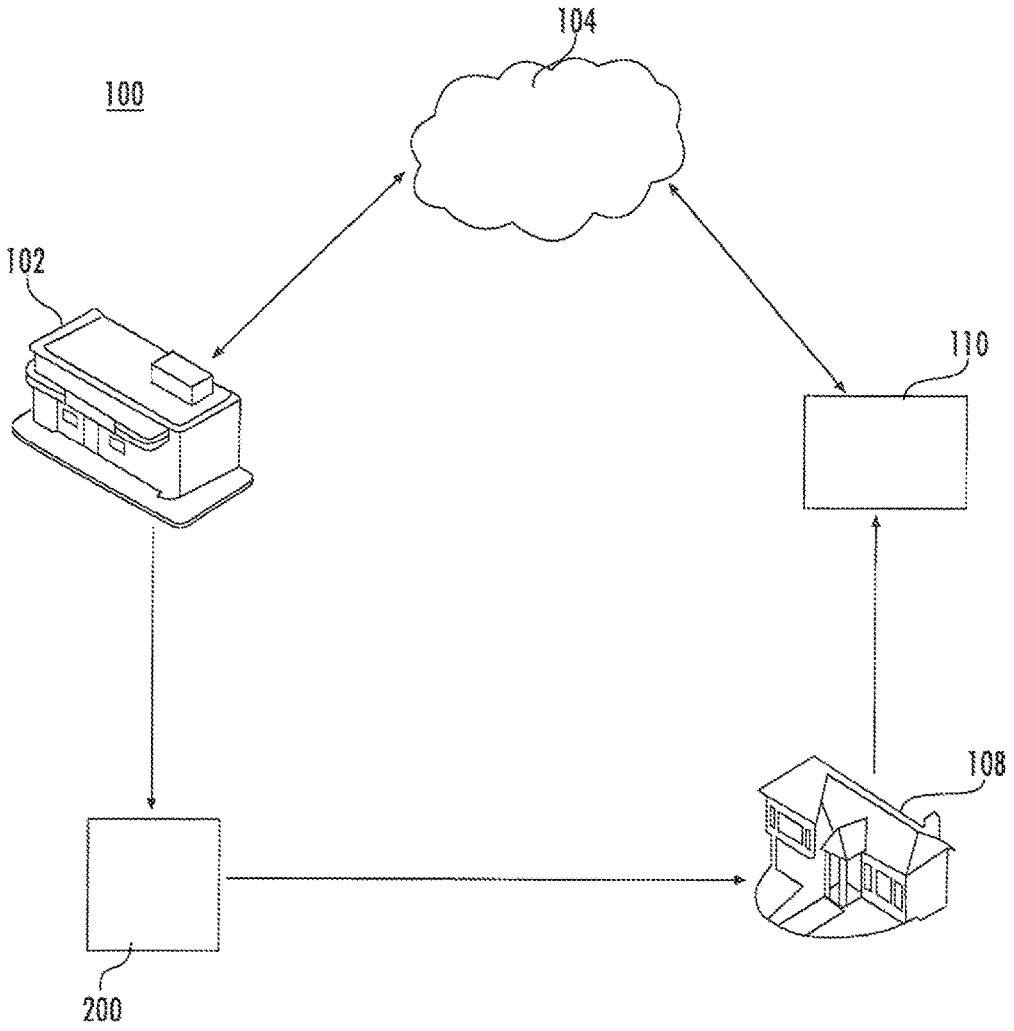
FIG. 1 is a schematic diagram that illustrates an overall arrangement in which is utilized the present system for preparing medicines for dispensing.

The present specification discloses a method and system that prepares medication cartridges for dispensing. In one embodiment, the present system automatically winds a strip of medication pouches around a spool within the dispensing cartridge and collects data that is coded on each pouch.

In one embodiment, the present system confirms the validity of each cartridge. The cartridge is typically mailed or otherwise delivered to the patient on a regular basis.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It, will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or, operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Figure 4A:
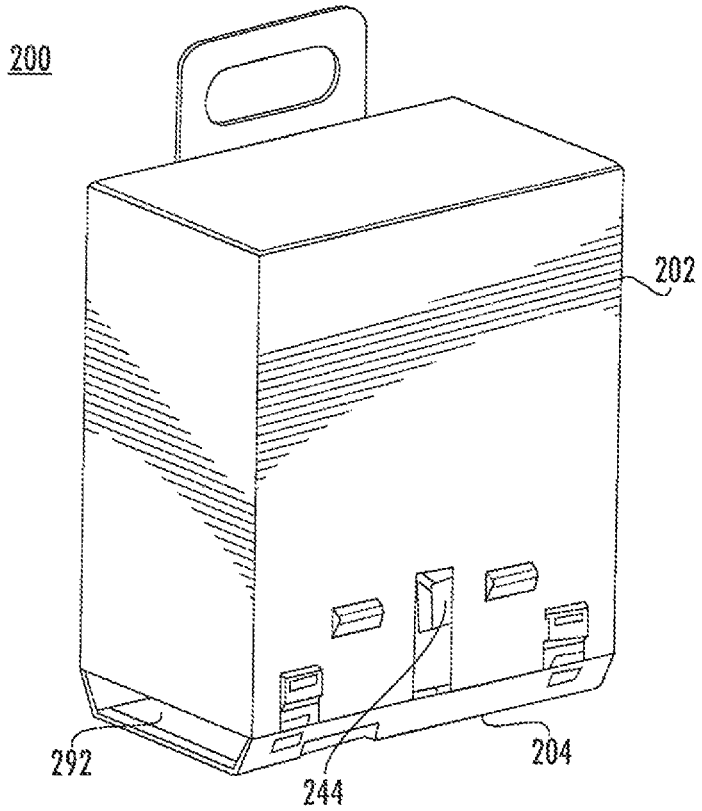
FIG. 4*a* is a front perspective view of an exemplary cartridge.
Figure 4B:
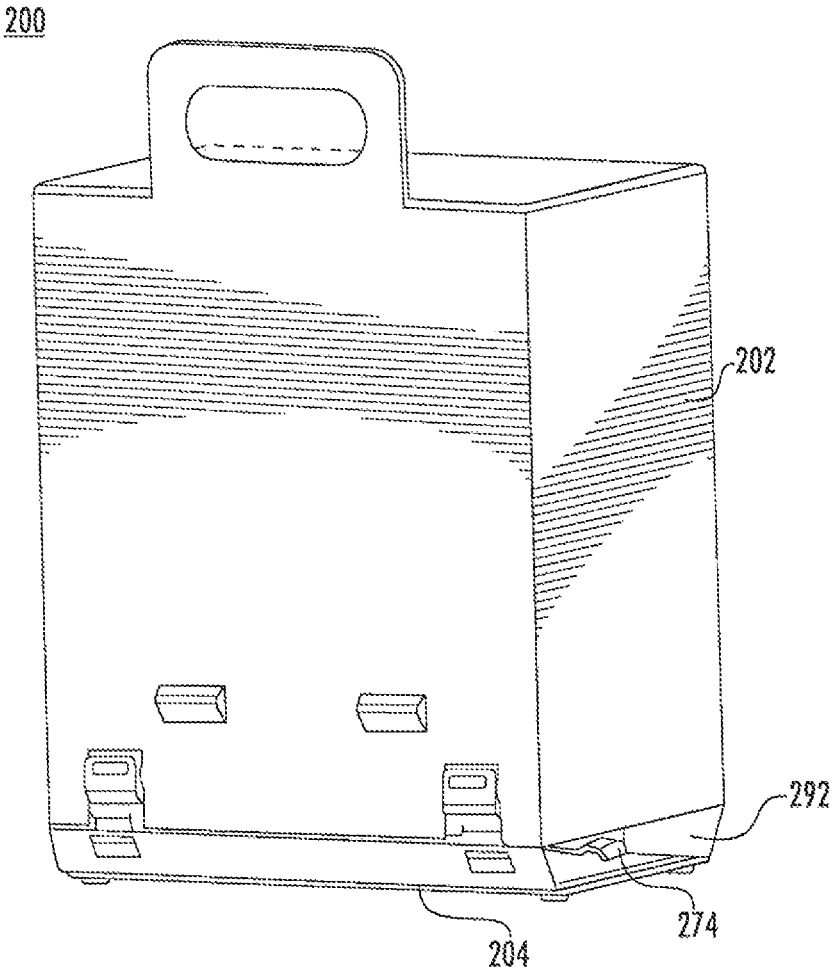
FIG. 4*b* is a rear perspective view of the cartridge of FIG. 3*a;*

As described above, the invention relates generally to a system and process for preparing cartridges for dispensing pharmaceuticals. A high level process incorporating the invention is described generally with reference to FIG. 1. The process begins with a medicine supplier 102, such as a pharmacy, that receives and processes prescriptions for a patient in any suitable, manner, in one embodiment, the prescriptions are sent to the medicine supplier 102 through a network, computer system, a "cloud" or any other communication mechanism 104, or they may originate through a paper prescription provided to the medicine supplier by the patient, as received from their physician or via a phone call or fax from a physician. Such prescriptions also may be refills of previously filled prescriptions for the patient. The medicine supplier packages the medications in pouches, according to the time that the medication is to be taken by the patient. Exemplary systems for the packaging of medications in pouches are described in U.S. Pat. Nos. 5,671,592 and 6,202,385, and are herein incorporated by reference in their entirety. Medications that are to be taken at the same time are packaged in the same pouch and each pouch is assigned a time of administration, in accordance with the prescription(s). It should be noted that more than one pouch may be required to package all the medications for a given administration time. For the sake of simplicity, a single pouch will be referred to herein, but should be understood to include one or more pouches, as necessary to accommodate a patient's medication regimen. U.S. Pat. No. 8,311,853 describes an exemplary system that can be used to assign administration times for groups of medications and align the refills for the prescriptions to facilitate the refill process for all medications packaged in the pouches for a single patient and is herein incorporated by reference in its entirety. A series of pouches are connected together to form a strip, such that a pouch may be removed from the strip, one at a time, through a cutting, tearing, or other removal mechanism. Pouches are ordered in the strip in chronological order, based on the date and time of administration. In one embodiment, a strip of medication pouches is loaded in a cartridge 200 (as shown in FIGS. 4A and 4*b* with the cover and in FIG. 5 without the cover), and sent to the user's home 108. In one embodiment, the cartridge 200 is sent periodically to the patient, and the periodicity is based on the patient's, preference—such as every week, every ten days, or once per month. The cartridge 200 contains medicines sufficient to last the predetermined period of time.

At the patient's home, the cartridge of packaged prescription medication is loaded by the patient into a dispensing unit 110. The cartridge 200 may be designed to automatically self-align with the dispensing unit 110, without the need for any installation work on the user's part. Therefore, the user may simply drop the cartridge 200 into the housing of dispensing unit 110 and apply sufficient pressure to cause the cartridge to snap in place. Once the cartridge 200 snaps in place, it is automatically aligned with the dispensing mechanisms and capable of dispensing medicines without further work, adjustment, or installation by the user as described in more detail below.

Figure 2A:
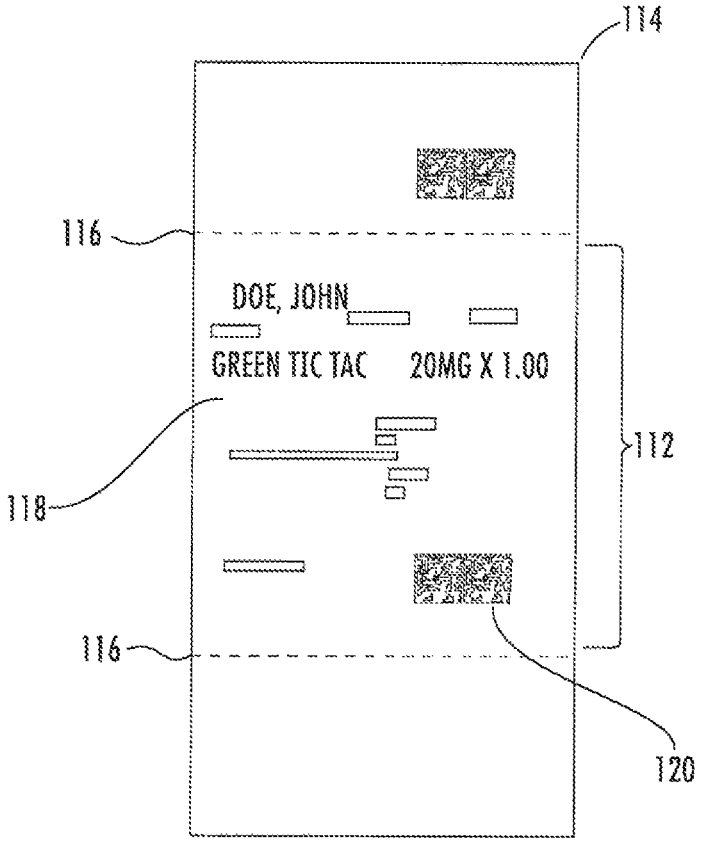
FIG. 2*a* is a top view of an exemplary pouch of medication, attached to a strip of pouches in a roll, to be loaded into a dispensing cartridge according to embodiments of the invention.

FIG. 2*a* illustrates exemplary pouches of medication, with each pouch containing the medicines to be taken by the patient at a particular time of administration, in accordance with their prescription(s). Individual pouches of medicine 112 are connected together to form a medication strip 114, which is loaded into a cartridge 200. The number of pouches 112 in the strip 114 depends on the number of days for which the patient has ordered the medicines. Thus, for example, a patient may order prescription medicines for one week; then the number of pouches 112 in the strip 114 corresponds to the number of times the patient has to take medicines each day times seven days. The patient may have a schedule established with the medicine supplier to automatically receive a new strip of pouches on a regular basis every two weeks, once per month, etc.). Individual pouches may be separated along the strip 114 by a transverse perforation or seam 116 that allows for easy separation of the pouches from the strip one at a time.

Figure 2B:
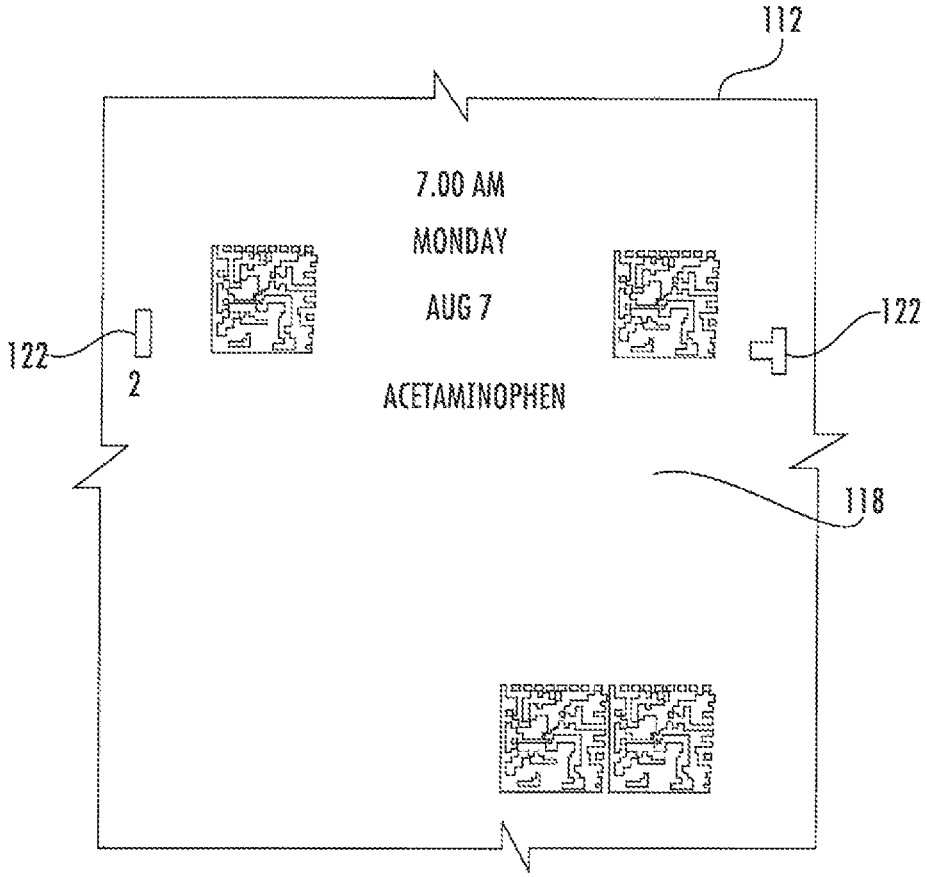
FIG. 2*b* is a top view of an individual pouch of medication.

Thus, one or more single or multi-medicine pouches 112 are prepared for each medication administration time for a predetermined period of time, and connected in the correct sequence to form a strip 114. The medication administration time may be time based or event based. For example, the administration time may be "9.00 a.m." or "Breakfast". FIG. 2*b* illustrates another exemplary pouch in which the administration time is indicated as "7:00 AM, Monday, Aug 07". Individual medicine pouches may be labeled with information 118, such as, for example, the name of the patient, date of packaging or manufacturing, expiry date(s) of the medications, date and time of administration, instructions for taking the medication (i.e., take with food), warnings (i.e., do not operate heavy machinery when taking this medication, do not drink alcohol when taking this medication), total number of pouches in the strip, and pouch contents, including the name, dosage, and number of pills of each medication; such information may be modified as necessary to comply with state and/or federal regulations. The medicine pouches 112 may each include a bar code 120 for identifying the individual pouch. The bar code 120 may also contain some or all of the information 118. In some embodiments, the bar code 120 may contain a unique pouch ID. The bar code also may include an encoded index which determines its order within the strip and may be used to determine the dispense time for that pouch. Each bar code also may contain information about the prior pouch and/or the subsequent pouch. This information can be used in processes for error recovery when the data collected from the bar code is incomplete or determined to be invalid. Pouches may include duplicate bar codes 120 located in separate areas of the pouch (for example, in either corner). Identification of pouches may additionally or alternatively be accomplished by RFID tag, colors, symbols, etc. Pouches may include one or more registration symbols 122 that may be used to facilitate pouch detection, particularly when using computer vision applications. In one embodiment, the pouches 112 are made from any suitable material that, meets federal requirements for medication packaging and is of any size suitable to properly accommodate medications and the dispensing unit 110.

It may be noted that the medicine supplier 102 that packages the medication into the pouches/strip may be a pharmacy themselves, or may be a third party with which the pharmacy has contracted for packaging/distributing the medications.

After the medications are packaged into pouches 112 corresponding to the appropriate doses for each time of administration for a single patient, the strip 114 of pouches for that patient is loaded into a dispensing cartridge 200. Each cartridge 200 is loaded with medicine pouches 112 sufficient to last a predetermined time frame specified by the patient, as explained above. The cartridge 200 with loaded medicines may be mailed, or otherwise delivered, to the patient on a regular basis. The cartridge 200 then can be loaded into a dispensing unit 110 for the patient and the individual pouches 112 can be dispensed at the appropriate times of administration. When the medication pouches 112 have all been dispensed, the used cartridge 200 may be disposed of, recycled, or may be returned to the medicine supplier 102, or other designated facility, for reuse.

Figure 3:
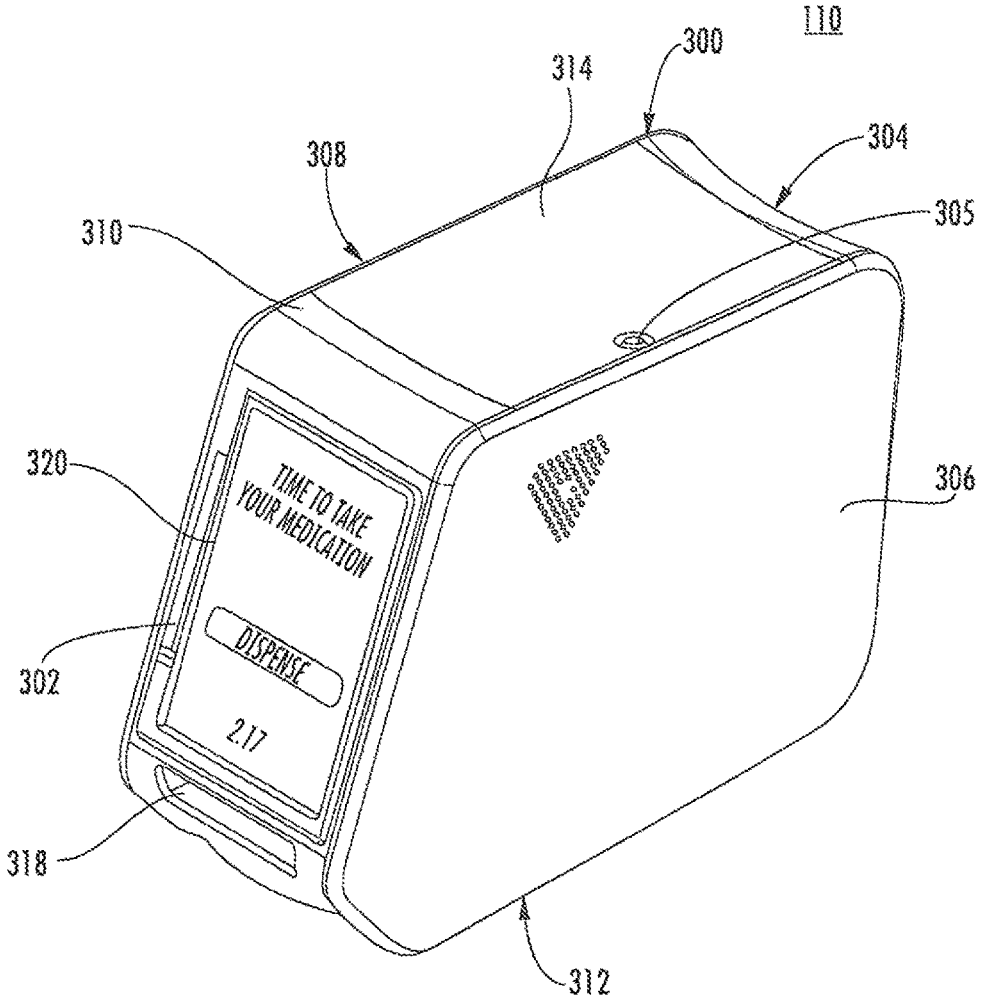
FIG. 3 is a perspective view of a dispensing unit that dispenses pouches of medication from cartridges loaded with medication strips according to embodiments of the invention.

FIG. 3 illustrates an exemplary dispensing unit 110. As can be seen in FIG. 3, dispensing unit 110 comprises a housing 300 with a front 302, back 304, sides 306, 308, top 310 and bottom 312. Top 310 includes a door 314 which is operable to expose an opening 316 in the housing 300 (see FIG. 9); the opening 316 provides access to the compartment 322 for receiving a cartridge 200 as described above. In the given example, an opening 316 is defined on the top 310 of the dispenser housing 300 such that the cartridge 200 may be dropped into the compartment 322 of the dispensing unit 110. It may be appreciated however, that an opening may also be defined in any portion of the dispensing unit 110, as long as it serves the purpose of conveniently inserting a cartridge 200 in the compartment 322. The door 314 may include a lock 315 to restrict access to the components of the dispensing unit 110 and, in particular, to the contents of the cartridge 200. The lock may be of a standard type requiring a key or combination, and/or may require radio frequency or biometric identification or other suitable security feature to unlock and provide access to the opening 316 and the contents of the dispensing unit 110. This locking feature may be desirable for both security and child-safety considerations. Further, display screen 320 functions also may be locked and require a user-defined PIN, biometrics or other security mechanism to unlock. The patient may choose whether or not to enable the various locking functions of the dispensing unit.

The dispensing unit 110 comprises a delivery slot 318 to dispense a medication pouch 112 at the requisite time of administration. Delivery slot 318 may be covered by a door. The dispensing unit 110 may further comprise a display screen 320 suitable for communicating with the patient and providing buttons and menus for the patient to interact with the dispensing unit 110 and make selections. Information communicated to the patient may include dosage information, notification that a pouch is ready to be dispensed, alerts for missed medication, refill requirement, errors, etc. as needed. The dispensing unit further may include a local or remote audible, visual, and/or tactile alarm or other device for notifying the patient that a medication pouch 112 is ready to be dispensed, has been missed or that a message is on the display screen. The functions of the display screen 320 may be used to allow the patient to enter information, answer questions, confirm his/her identity, etc.

Dispensing unit 110 may be equipped with a radio receiver, which allows a user to tune into radio stations when a medicine pouch 112 is not being dispensed. Screen 320 of the dispensing unit 110 may be used as a digital photo frame when communications on the display are not required.

Dispensing unit 110 may be equipped for networking with a secured wireless network such as a home Wi-fi or cellular broadband service. Dispensing unit 110 may be additionally or alternately equipped with a secured. Ethernet connection as well as an RJ-45 jack (i.e., a telephone jack) as means of communication. A network connection enables the dispensing unit 110 to communicate with the cloud, as necessary, to receive information such as updates, electronic medication administration records (eMARs), schedules, and alerts provided to the cloud by the patient's medicine supplier, physician, clinical study coordinator, etc. The dispensing unit 110 also may provide information to the cloud such as adherence data, verification information, answers to questions, etc. The dispensing unit 110 may further use this communication path to send out requests for replenishment or help, or to communicate discrepancies in data (i.e., downloaded eMAR does not match patient identification) or a change in medications or schedules, in one embodiment, all data is sent and received via the cloud 104.

Dispensing unit 110 comprises a suitable controller or microprocessor to control the operation of various components of the dispensing unit 110 and to communicate with the medicine supplier, caregiver, or other appropriate individual or organization (i.e., study teams, insurance providers, etc.). Dispensing unit 110 farther comprises an internal memory, such as RAM, for storing the controller's instructions and an internal or external memory for downloading and uploading required data to the cloud.

The dispenser unit 110 may have a graphical user interface (GUI), which is displayed on the screen 320 and helps a user to navigate through and select various options from the functions of the dispensing unit 110.

Figure 4C:
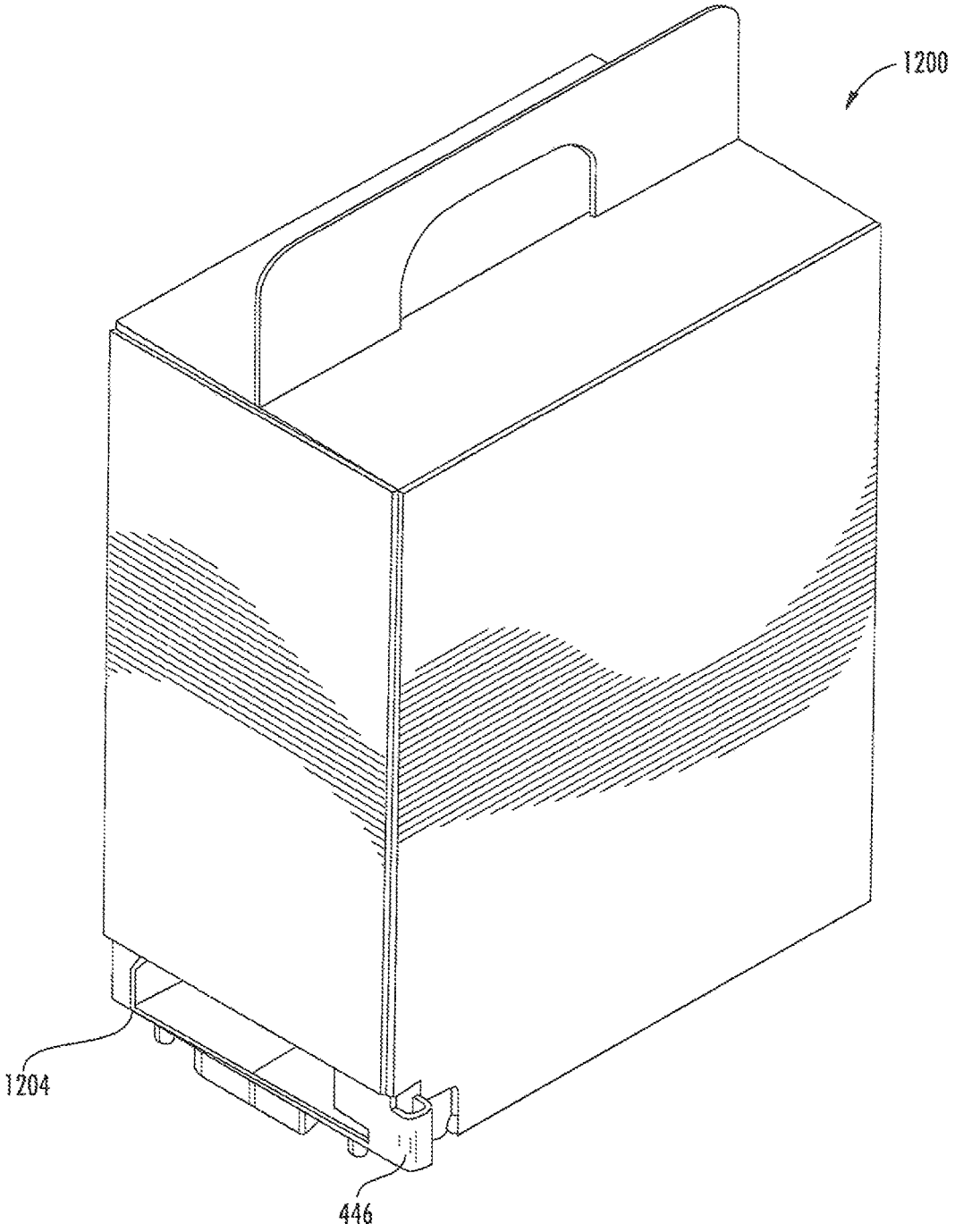
FIG. 4*c* is a front perspective view of an alternative cartridge.
Figure 14:
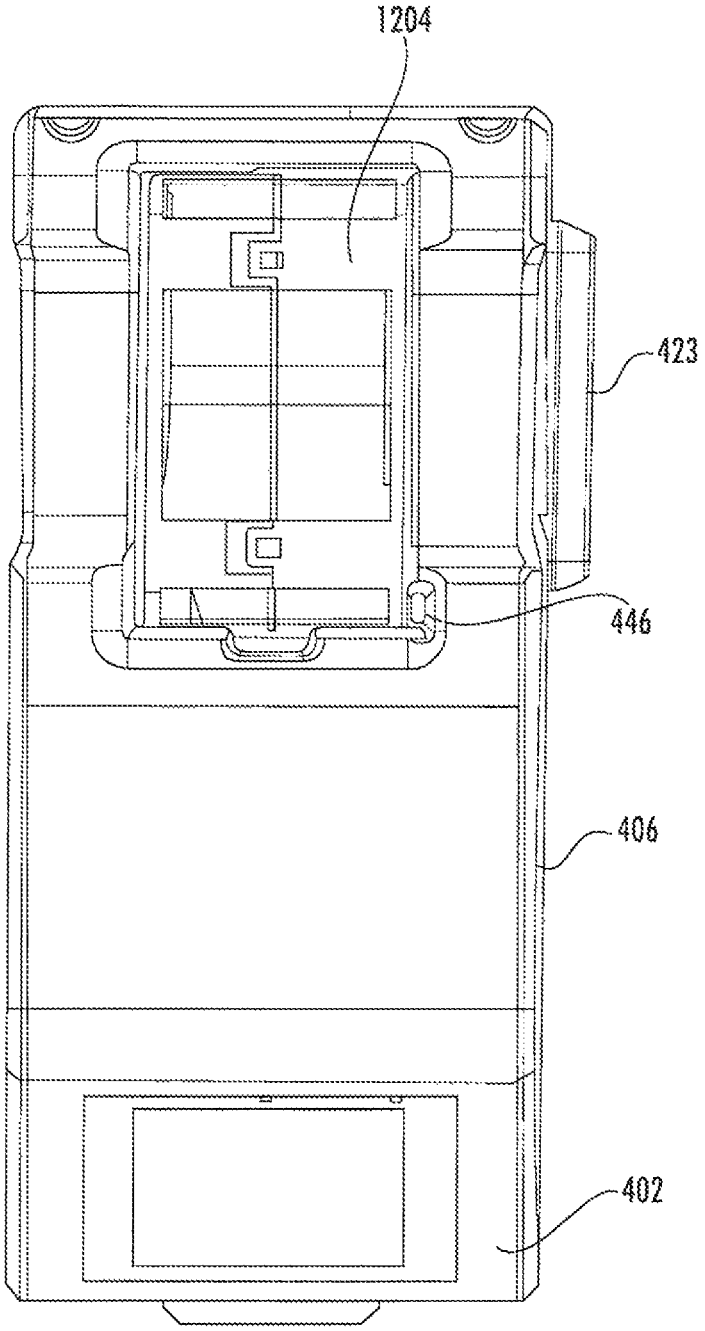
FIG. 14 is a top view of the spooler of FIG. 11.

FIGS. 4*a* and 4*b* illustrate an exemplary cartridge 200 which comprises a cartridge cover 202 and a cartridge frame 204. Cartridge cover 202 may contain information encoded in barcodes, RFID tags, text, pictures, braille, etc. Some or all of this information may be printed on the cover, or some or all of it may be added with one or more labels. The cartridge cover information may include, but not be limited to: information about the patient such as name, address, medical diagnosis or other identifying information; prescription number; refills remaining; information about the medication such as drug name, NDC or DIN, description, image, number of tablets in the cartridge, applicable warnings, administration instructions; information about the physician such as name, phone number or address; information about the pharmacy filling the prescription such as name, address, phone number. Cartridge 200 may include features to ensure proper placement of the cartridge in the dispenser 110 or spooling unit 400. In one embodiment, shown in FIG. 4*a*, this feature consists of a wedge 244 protruding from the side of the cartridge frame, through a hole in the cover 202; when the cartridge 200 is inserted in the compartment 322 of dispenser 110, wedge 244 is accommodated by channel 326 (see FIG. 9) on one side of the compartment 322, which allows the cartridge 200 to be inserted in only one orientation within the compartment 322. The compartment 422 of spooler unit 400 would have a similar channel on one side to accommodate the wedge 244. FIG. 4*c* shows another embodiment, cartridge 1200, where cartridge frame 1204 may include a projection 446 on one corner so that frame 1204 can be inserted in compartment 422 in only one orientation. Referring to FIG. 14, it can be seen that the projection 446 is positioned in the corner nearest the front 402 and side 406 and can only be accommodated in this location. Cartridge 1200 also may be used in a dispenser unit with similar modifications made in the compartment 322 to accommodate the features of cartridge 1200. Cartridge 200 or cartridge 1200 may be used interchangeably herein with the understanding that the spooler 400 would require appropriate modifications, understood by one of skill in the art, to accommodate the above-referenced differences in features, but that the functionality otherwise is not changed.

Figure 5:
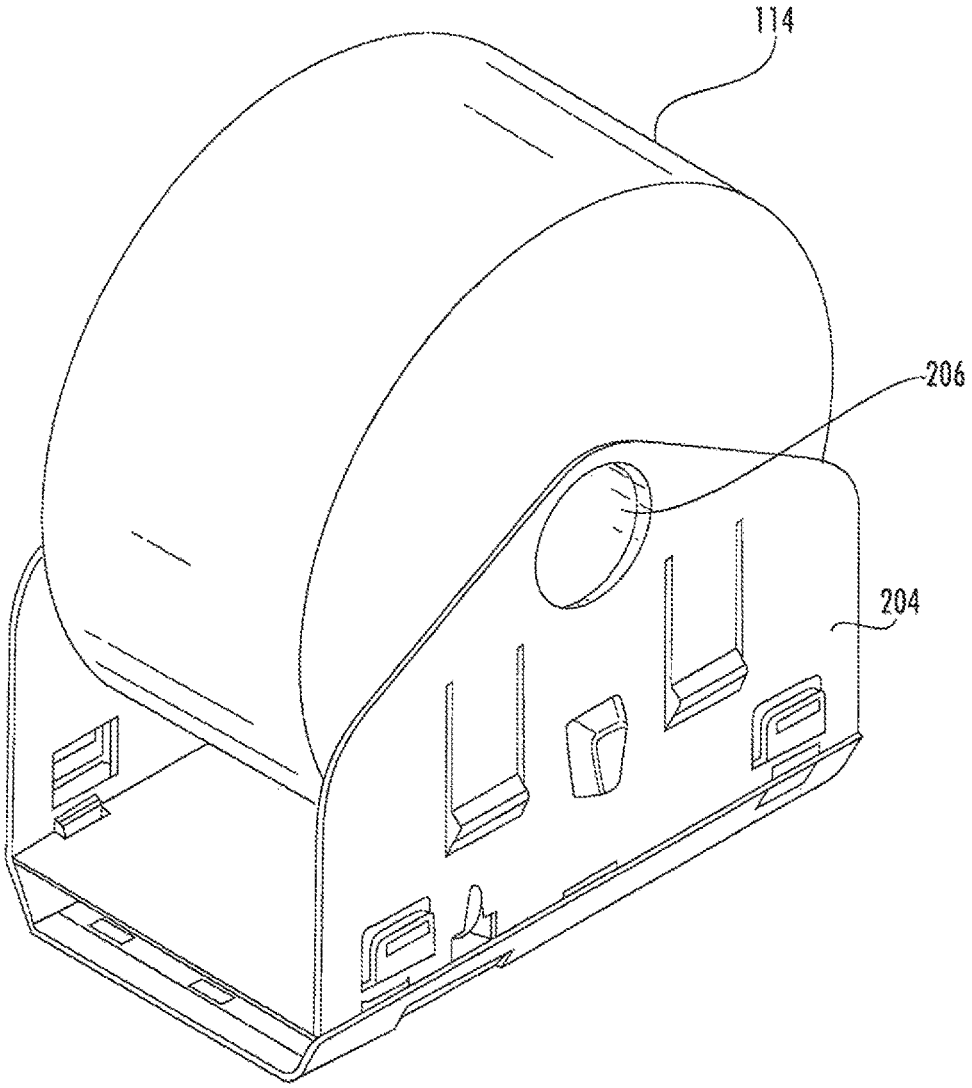
FIG. 5 is a perspective view of a cartridge frame loaded with a strip of medication pouches for use in the cartridge of FIG. 4*a;*

FIG. 5 illustrates an exemplary cartridge 200 with the cover 202 removed. The frame 204 is loaded with a strip 114 of medication pouches that have been rolled around a cylinder 206. The cartridge frame 204 is sized and configured to fit into a dispenser unit 110 located in the patient's home.

Figure 6:
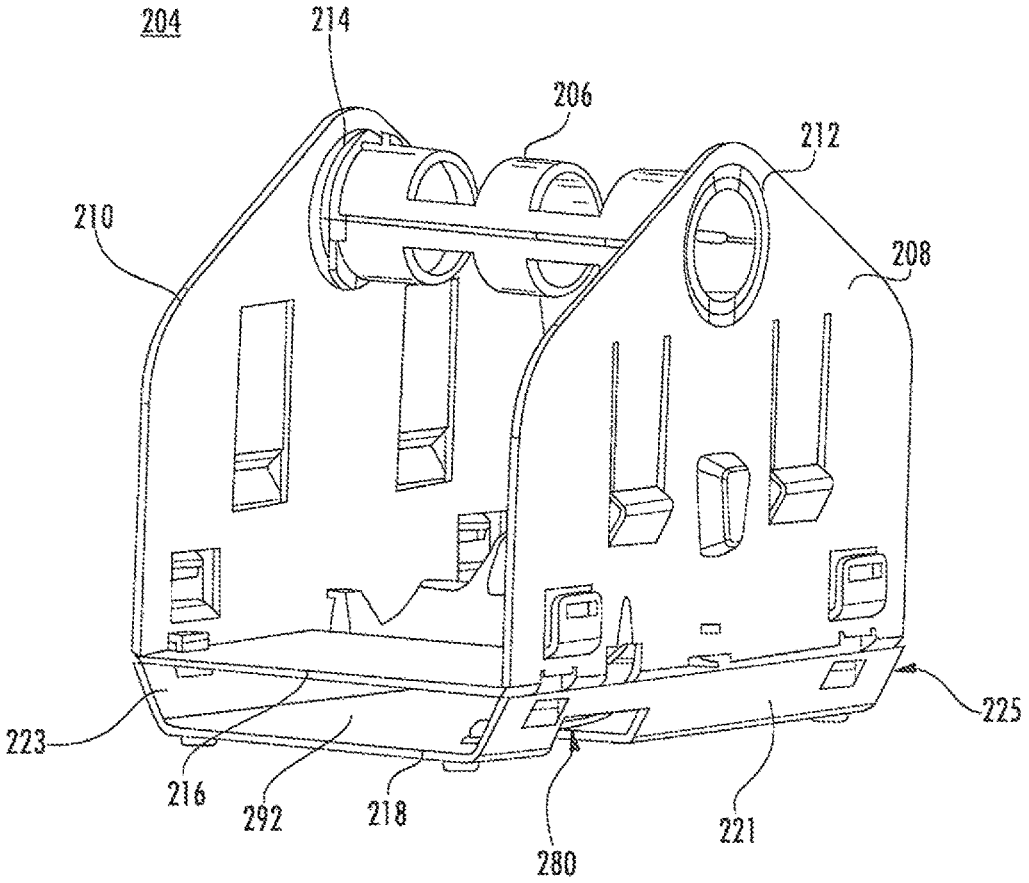
FIG. 6 is a front perspective view of the cartridge frame of the cartridge of FIG. 4*a;*
Figure 7:
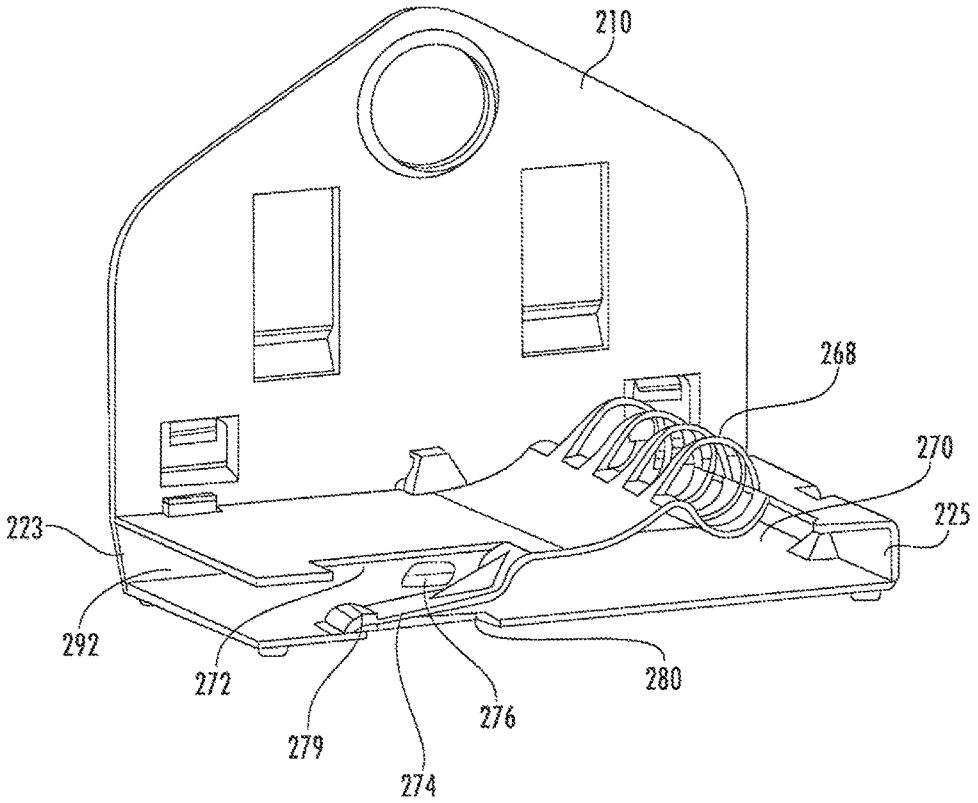
FIG. 7 is a section view of the cartridge frame of FIG. 6, without the cylinder.

The structure of one embodiment of the cartridge frame 204 can be seen in further detail with reference to FIG. 6. FIG. 6 is a perspective view of the cartridge frame 204. In one embodiment, the cartridge frame 204 comprises sidewalls 208, 210, a floor 216 with a routing hole 270, and a base 218 with a rear wall 225 and side walls 221, 223. As can be seen in the cross-section view of the cartridge frame 204 shown in FIG. 7, extending forward from the rear edge of hole 272 in the floor 216 and positioned over a hole 280 in the base 218 is an arm 274 that serves as a brake member. The free end of arm 274 is arched and is positioned over a notch 284 on the upper surface of base 218, on the opposite side of hole 280.

Figure 8:
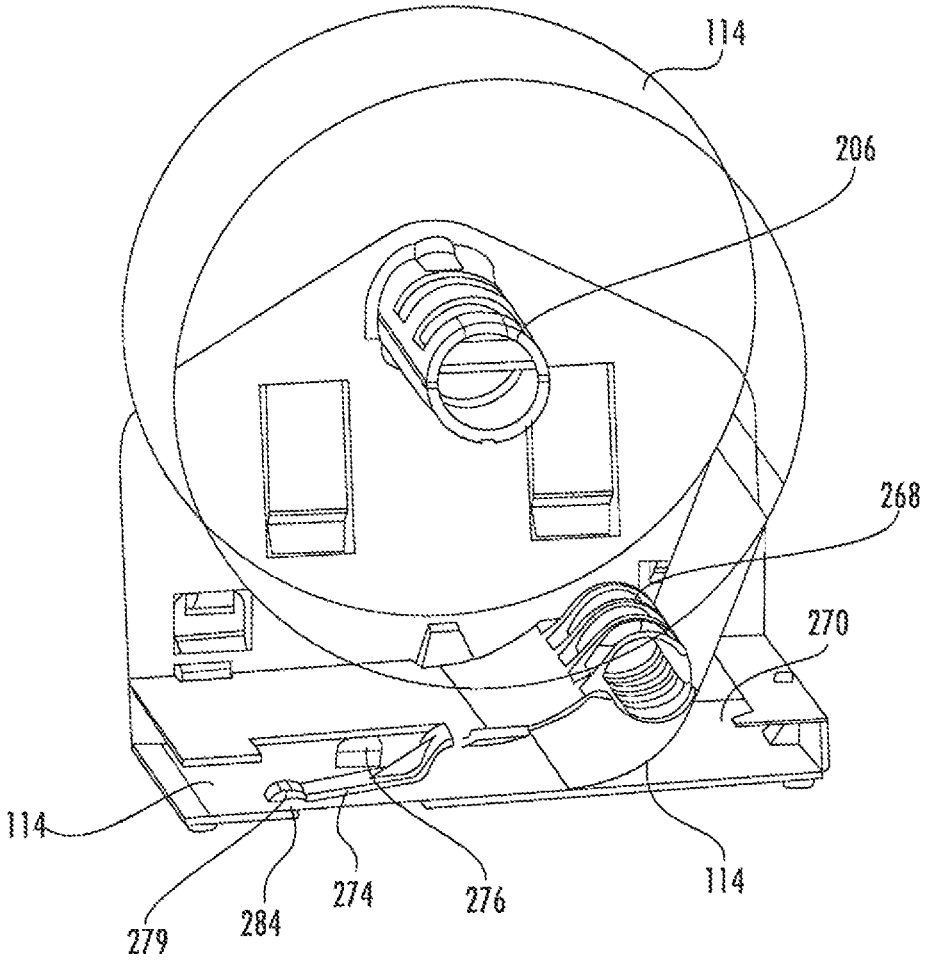
FIG. 8 is a section view of the cartridge frame of FIG. 6 with a medication strip loaded on the cylinder and following its path through, the frame.

FIG. 8 shows the location of a medication strip 114 when loaded on the cartridge frame 204. The medication strip 114 is loaded on the cylinder 206 so that its free end exits the roll in the direction of the rear of the cartridge frame 204 (defined by the rear wall 225 of the cartridge base 218). The free end of the strip 114 is then fed through hole 270 in the floor 216. The loops 268 provide a rounded surface past which the strip 114 can more easily move. The strip 114 is now in the space between the base 218 and the floor 216. The strip then passes under arm 274, moving toward the front of the cartridge (opposite rear wall 225). The strip 114 remains between the base 218 and floor 216 such that it passes between notch 284 and the arch 279 of arm 274 as it passes out of the cartridge through the front opening 292. The positioning of the strip between the notch 284 and arch 279 of arm 274 allows the strip to be held securely in place, particularly during transport. As the strip 114 follows this path it passes over hole 280.

In one embodiment, the cartridge sidewalls 208, 210 are substantially pentagonal in shape, with the rectangular portion of the pentagon forming the lower portion of each sidewall, below the triangular portion. Cylinder 206 can be inserted into holes 212, 214 located in the triangular portion of sidewalls 208, 210. In one embodiment, the frame 204 and cylinder 206 may be made of injection moldable plastic, such polypropylene or polyethylene, for example, metal, such as steel or aluminum, for example, or a composite material, such as fiberglass or a heavy-duty cardboard, for example.

Figure 9:
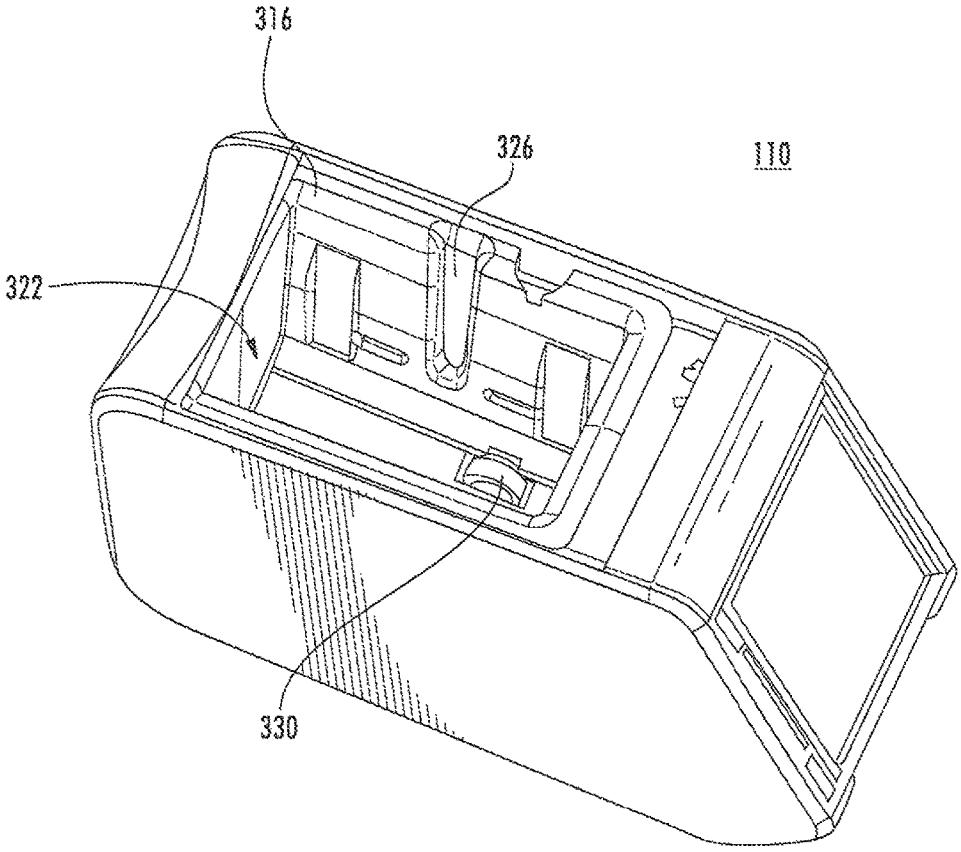
FIG. 9 is a top perspective view of the dispensing unit of FIG. 3 with the top door removed to show the compartment into which the cartridge fits.

FIG. 9 illustrates the dispensing unit 110 of FIG. 3 with the door 314 removed to reveal the opening 316 and the compartment 322 into which the cartridge 200 is inserted for dispensing of medication pouches 112 from the cartridge 200. Compartment 322 includes one or more features, such as channel 326, to ensure that the cartridge can be loaded in one direction only and will be properly aligned within the compartment 322, with the front of the cartridge and opening 292 facing toward the front 302 of the dispensing unit 110, as discussed above.

Figure 10:
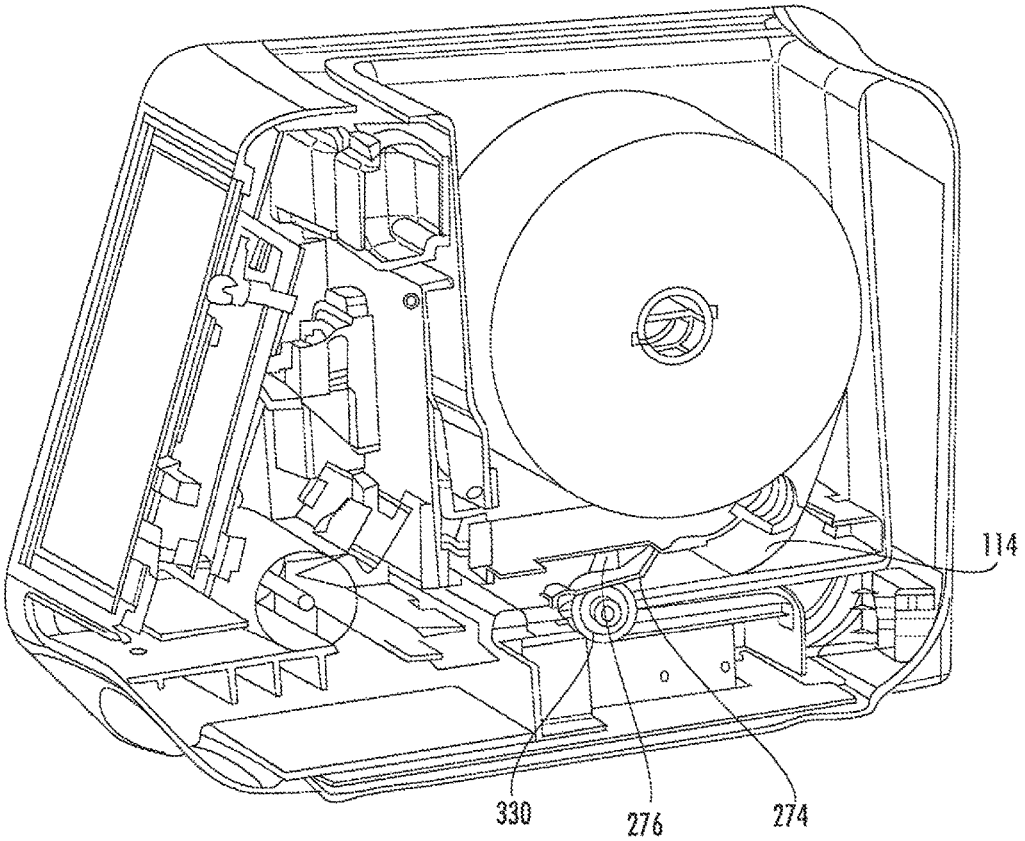
FIG. 10 is a perspective section view of the dispenser of FIG. 3 with a cartridge loaded in it.

FIG. 10 shows a cross-section of the dispensing unit 110 with a cartridge 200 loaded in compartment 322. The dispensing unit 110 includes a roller 330 or other drive unit that extends into the compartment 322. When a cartridge 200 is properly loaded into the compartment 322, roller 330 is positioned in line with hole 280 in the base of the cartridge 200, along its lateral edge, directly opposed to arm 274. Roller 330 extends through hole 280, contacting the strip 114 along its side seam and pressing it against arm 274 such that, when it is time to dispense a pouch 112, roller 330 is able to move strip 114 forward and through the opening 292 through frictional interaction with the pouch 112 against arm 274. Another small arm 276, which may be a protrusion located on the inner surface of sidewall 208 just above arm 274, provides resistance to the pressure of roller 330 against arm 274 by limiting the ability of arm 274 to move away from the roller 330.

Further details regarding the structure, function, system and method of dispensing using embodiments of the cartridge and dispenser discussed above may be found in U.S. Patent Application Nos. 62/171,646, 62/263,345, 62/292,713, and Ser. No. 15/172,646, which are hereby incorporated by reference in their entirety.

To prepare the cartridge 200 for dispensing, the medication strip 114 may be wound around the cylinder 206 prior to insertion of the cylinder 206 into the holes 212, 214 of cartridge frame 204. U.S. Patent Publication No. 2013/0264376 describes an exemplary system that can be used to wind a strip of medication pouches into a roll and is hereby incorporated by reference in its entirety. Alternatively, the cylinder 206 may be first inserted into the frame 204, either by the frame manufacturer or in an assembly process performed at the facility of the supplier 102. Then, using a fully assembled cartridge frame 204, the medication strip 114, may be loaded onto the cylinder 206 to produce the loaded cartridge. The systems and methods of the invention may be used to wind the strip 114 of pouches 112 onto the cylinder 206 in an assembled cartridge frame 204.

Figure 11:
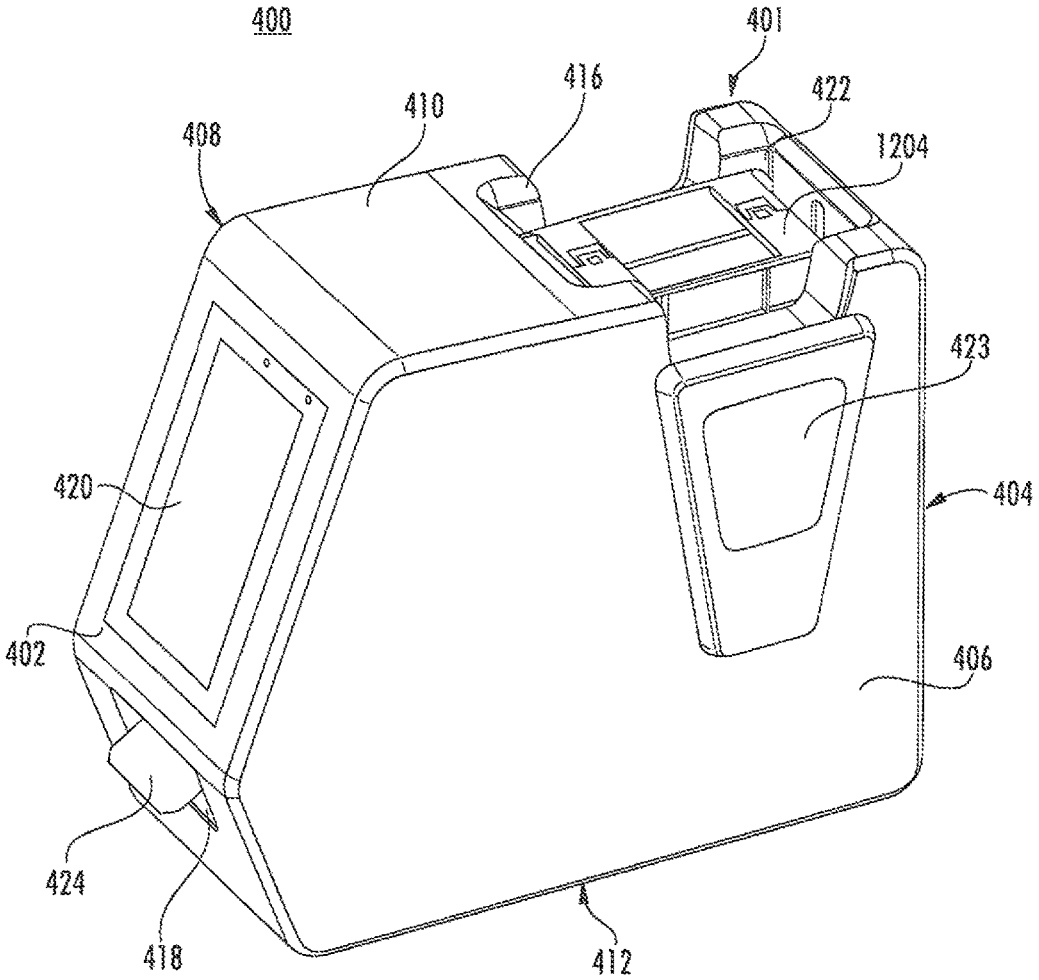
FIG. 11 is a perspective view of a spooler device with an empty cartridge frame loaded in the compartment, according to embodiments of the invention.
Figure 13:
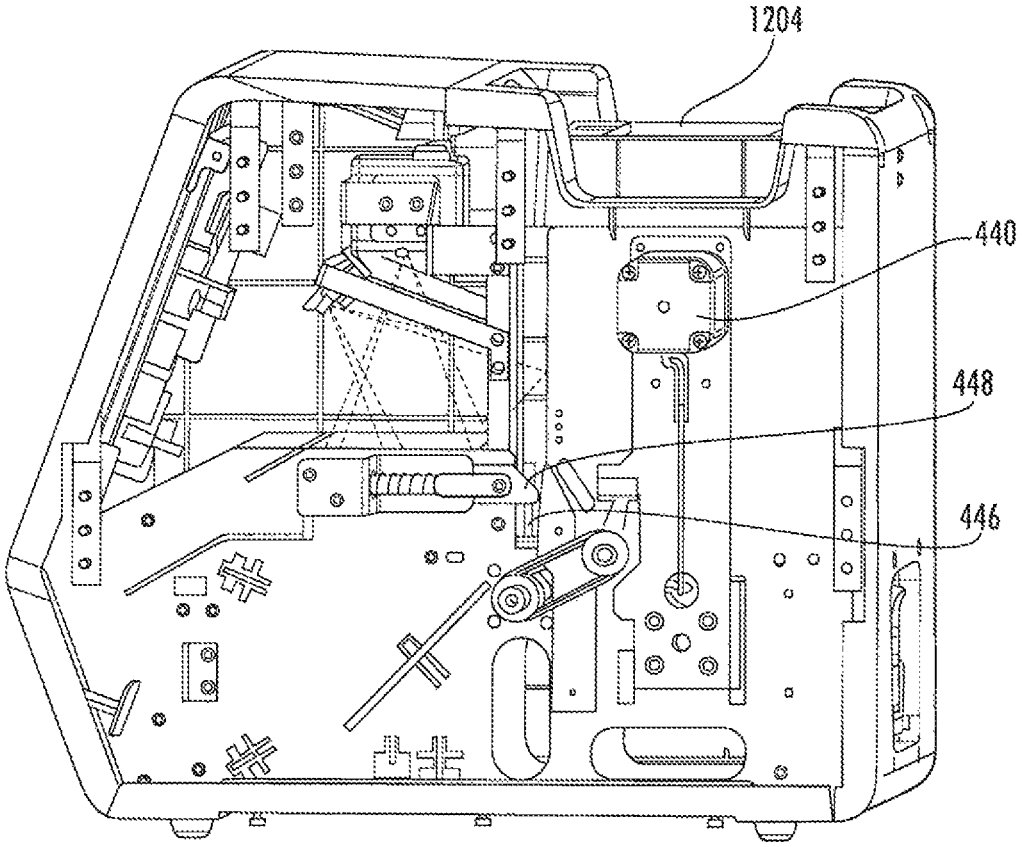
FIG. 13 is a side view of the spooler of FIG. 11 with the side panel removed.

FIG. 11 illustrates an exemplary spooler device 400 of the invention. As can be seen in FIG. 11, spooler device 400 comprises a housing 401 with a front 402, back 404, sides 406, 408, top 410 and bottom 412. Top 410 includes an opening 416 which provides access to the compartment 422 for receiving a cartridge frame 204 or cartridge 200, in the given example, an opening 416 is defined on the top 410 of the spooler housing 401 such that the cartridge 200 or cartridge frame 204 may be dropped into the compartment 422 of the spooler 400. It may be appreciated, however, that an opening may also be defined in any portion of the spooler 400, as long as it serves the purpose of conveniently inserting a cartridge 200 or cartridge frame 204 in the compartment 422. The spooler includes a button 423, located on side 406 in the exemplary unit, which can be used to engage the spool drive 440 (FIG. 13). One of skill in the art will recognize that the button 423 can be of other forms and mechanical designs as long as it is able to provide engagement (and disengagement) of the spool drive 440.

Spooler 400 may be equipped for networking with a secured wireless network such as a Wi-fi or cellular broadband service. Spooler 400 may be additionally or alternately equipped with a secured Ethernet connection as well as an RJ-45 jack (i.e., a telephone jack) as means of communication. A network connection enables the spooler 400 to communicate with the "cloud," as necessary, to receive information such as updates, information about the medication strips, etc. The spooler 400 also may provide information to the "cloud" such as which pouches were read into the cartridge when it was loaded (i.e., information from the barcodes on the pouches, the number of pouches, the date range of the dispense time on the pouches), the sequence of pouches loaded in the cartridge, pictures of the contents of the pouches, etc. The spooler 400 may further use this communication path to send out requests for error correction or repair, or to communicate discrepancies in data (i.e., loaded pouches do not match cartridge information). In one embodiment, all data is sent and received via the cloud 104.

Spooler 400 comprises a suitable controller or microprocessor to control the operation of various components of the spooler 400 and to communicate with the user. Spooler 400 further comprises an internal memory, such as RAM, for storing the controller's instructions and an internal or external memory for downloading and uploading required data to the cloud.

In one embodiment, the spooler 400 further comprises a display screen 420 suitable for communicating with the user and providing buttons and menus for the user to interact with the spooler 400 and make selections. The spooler 400 may have a graphical user interface (GUI), which is displayed on the screen 420 and helps a user to navigate through and select various options from the functions of the spooler 400. Information communicated to the user may include, but is not limited to, instructions, cartridge information, patient information, medication information, errors, etc. as needed. In one embodiment, the spooler 400 further includes a local or remote audible, visual, and/or tactile alarm or other device for notifying the user of various situations which may require user attention, including, but not limited to, that the system is ready to use, that the cartridge frame 204 is full, that the cartridge 200 has been validated, that there is a problem with the loading or validation process, or that a message is on the display screen. In one embodiment, the screen 420 may be used to allow the user to enter information, answer questions, confirm his/her identity, etc.

The spooler 400 includes a slot 418 through which a medication strip 114 can pass for loading in the cartridge 200. In the exemplary unit, the slot 418 and the display screen 420 are located on the front 402 of the spooler 400 but may be positioned in any convenient and functional location on the spooler 400. A remote display screen such as, for example, a computer monitor, cell phone, tablet computer, etc. may be used in place of or in addition to the display screen 420, with wired or wireless communication between the remote screen and the spooler unit 400.

FIG. 11 also shows a cartridge frame 204 seated in the compartment 422 in preparation for loading; the end of a starter strip 424 (described below) is shown protruding from the slot 418.

Figure 12:
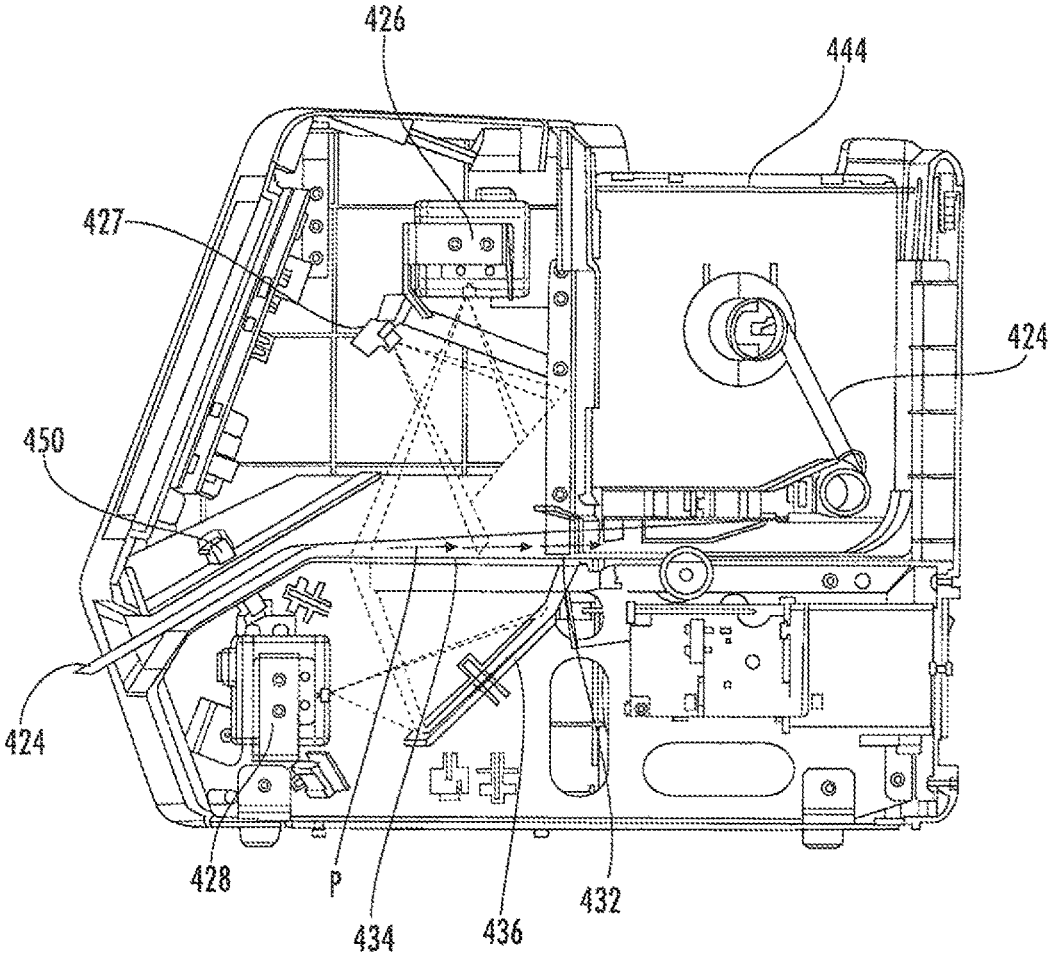
FIG. 12 is a section view of the spooler of FIG. 11.

FIG. 12 illustrates a cross-section of the spooler 400 of FIG. 11. FIG. 12 shows that the cartridge frame 204 may include a starter strip 424 that is attached to the cylinder 206. The starter strip 424 may be a piece of plastic, paper, fabric, or other appropriate material to which the medication strip 114 may be attached. Attachment of the starter strip 424 to the cylinder 206 may be achieved in any way that can secure the end of the starter strip 424 in place, such as by attachment with an adhesive (for example, tape or glue) or by insertion into a slot in the cylinder 206. The starter strip 424 is of sufficient length to pass from the cylinder 206 through the cartridge frame 204, be advanced along a path P (which also is followed by the medication strip 114) by roller 430 (FIG. 16) to the front of the spooler unit 400 and out through the slot 418. Before the cartridge is inserted into the spooler compartment 422, the starter strip 424 is wound around the cylinder 206, follows the path of the medication strip through the cartridge frame, and is held in place by the arm 274 near the opening 292 at the front of the cartridge frame 204.

Figure 16:
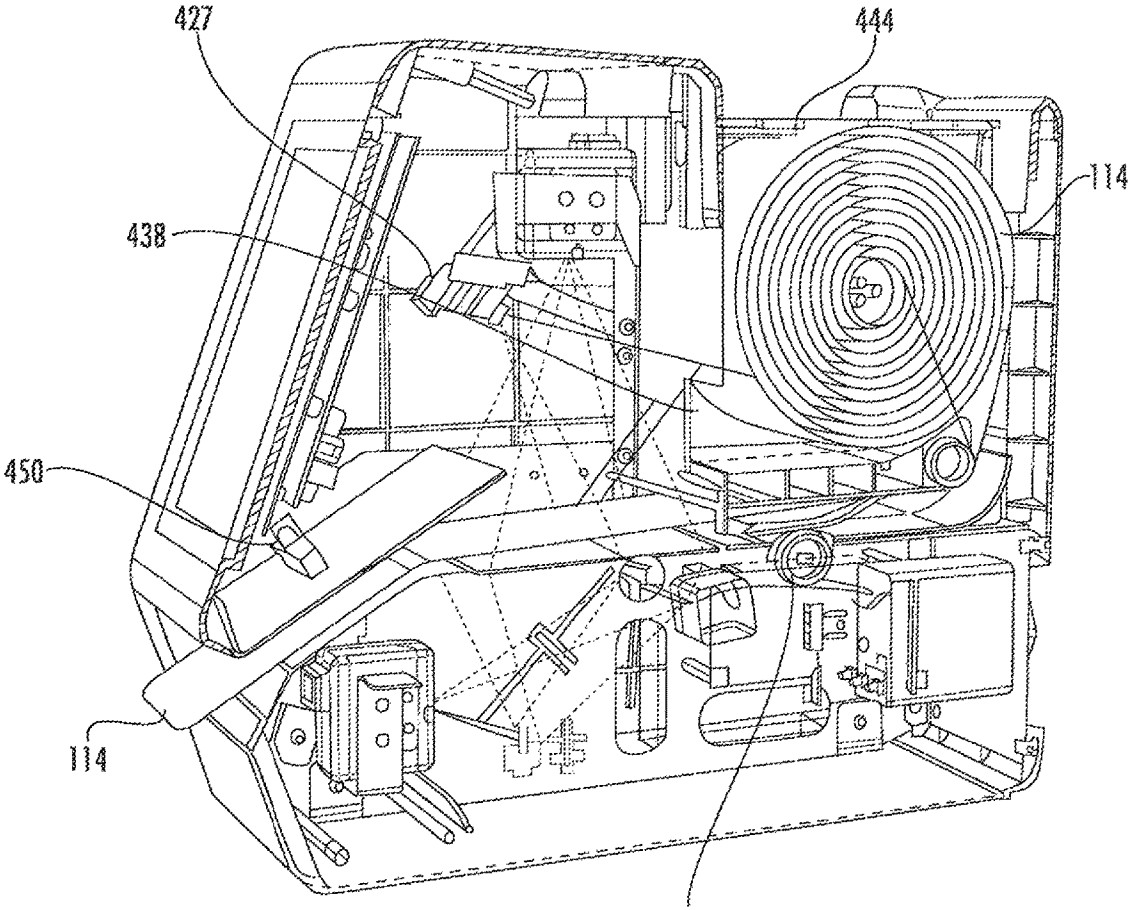
FIG. 16 is a perspective, section view of the spooler FIG. 11 with a medication strip loaded on the cylinder of the cartridge frame.

Referring to FIG. 16, a roller 430 is positioned to extend through the hole 280 in the base 218 of the cartridge frame 204, contacting the starter strip 424 (or medication strip 114 along its side seam) and pressing it against arm 274 such that, when it is time to move the starter strip 424 or medication strip 114, roller 430 is able to move the strip 424 or 114 through frictional interaction with the strip 424 or 114 against arm 274. Arm 276 (FIG. 10) provides resistance to the pressure of roller 430 against arm 274 by limiting the ability of arm 274 to move away from the roller 430.

Referring back to FIG. 12, the spooler 490 may include several sensors. In the exemplary embodiment, some of the sensors are cameras, with appropriate lighting sources, and are used for reading information from the pouch 112 and cartridge 200. Camera 426 is located above the path P and may be used to image the top of the pouches 112 as the strip 114 is being loaded into the cartridge frame 204. This image includes the barcode 120 on the top of the pouch 112; in this way the system is able to capture all the data associated with each pouch 112. In one embodiment, the paper used to create at least the top side of the medication strip 114 is white, so as to make the information on the pouch 112 more easily discerned in the image. Camera 428 is located below the path P and may be used to image the bottom of the pouches 112 as the strip 114 is loaded into the cartridge frame 204. As the medication strip 114 travels over path P, it moves along a platform 432 which contains a window 434; the window 434 allows the bottom of the pouches 112 to be viewed from below. In the exemplary spooler 400, camera 428 is located such it is not able to directly image the pouches 112; therefore, a mirror 436 is positioned at an appropriate angle so as to align the reflection of the pouches 112 with the camera 428 so that the images of the pouches 112 can be captured. In one embodiment, the paper used to create at least the bottom side of the medication strip 114 is transparent and the pills can be viewed through the paper. The images captured by camera 428, then, may include each of the pills in the pouches 112; these images may be displayed on the display screen 420 or other accessible display screen to assist in pharmacist verification of the content of the pouches 112 and may be stored as a record of the prescription fulfillment process. Images of the pills also may be used in an automated process to analyze and verify pouch contents. Exemplary spooler 400 also includes camera 427 which is located above the path P and positioned at an angle relative to the path P. Camera 427 may be used in the validation process, as will be discussed below, to capture the pouch barcode 120 and cartridge barcode 294 (through a hole 438 in the compartment 422; see FIGS. 16 and 17) in a single image. In the exemplary embodiment, sensor 444 is located at the top of compartment 422, in one embodiment, sensor 444 is a through-beam sensor. When the medication strip roll becomes large enough to break the beam of sensor 444, the sensor signals that the cartridge frame 204 is full. There will be an additional one or more pouches left to be wound on the spool (those located between the slot 418 and the cartridge opening 292); therefore, the location of sensor 444 and the computer processes related to its function take into account that sufficient room must be left on the spool for these pouches once a "full cartridge" is signaled. In the exemplary embodiment, sensor 450 is located near the slot 418. In one embodiment, sensor 450 also is a through-beam sensor and is able to detect the end of the medication strip 114. The system also or alternatively may identify the end of the strip 114 by counting the pouches 112 as they are loaded in the cartridge 200; information regarding the number of pouches 112 in a strip 114 may be provided directly to the spooler 400 by the user (entered manually), may be transferred from a computer or other device (e.g., cell phone, tablet, etc.), or may be contained within a code (e.g., bar code, RFID, or other appropriate code) contained on the first pouch 112. The pouch count information also may be provided in a code that is attached to the cartridge 200 prior to insertion, in the spooler 400; this code may be created when the strip 114 is created.

Figure 17:
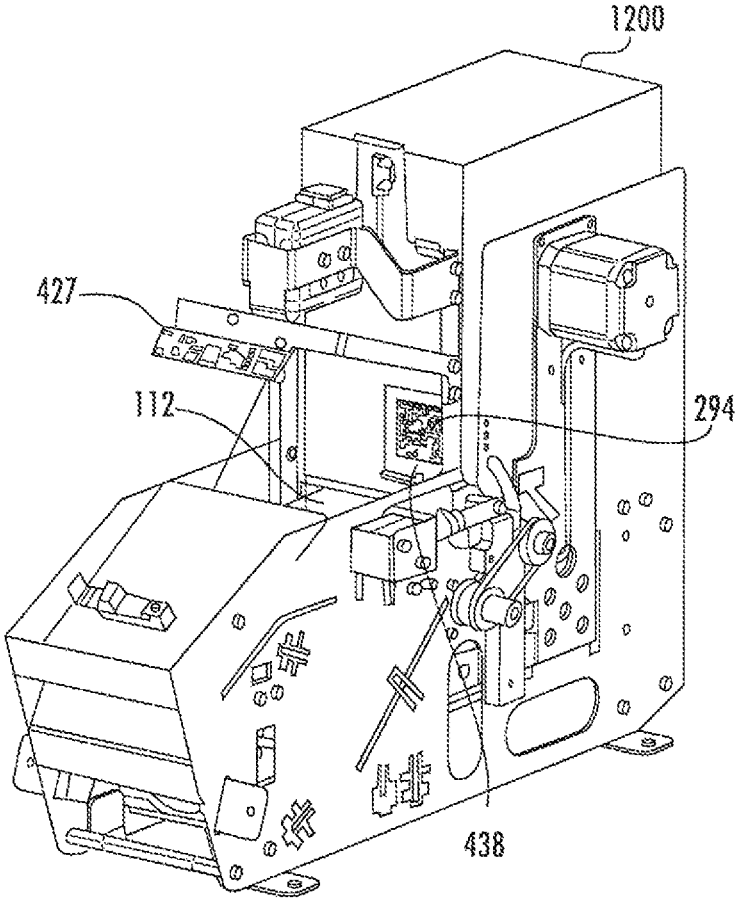
FIG. 17 is a top perspective view of the spooler of FIG. 11 with the housing removed and a loaded cartridge, with cover, in the compartment.

FIG. 17 demonstrates how camera 427 may be positioned to capture an image of both the pouch 112 information and the information on the cartridge 200. As discussed below, once the medication strip 114 has been loaded in the cartridge frame 204, the cartridge frame 204 is removed from the compartment 422 of the spooler 400 and the cover 202 and one or more labels, if necessary, are added. The cover 202 and/or labels) may include coded information (i.e., barcode, RFID, or other machine readable code) regarding the contents of the cartridge 200, the patient, etc. as discussed above. The coded information is positioned so that it can be viewed by the appropriate sensor—in the exemplary embodiment, a cartridge barcode 294 is located in the lower corner of an end of the cover 202 and the cover 202 is put on the cartridge frame 204 so that the barcode 294 is located in a front corner (e.g., the same corner as the projection 446 of the cartridge 1200). Thus, when the complete covered cartridge 200 is inserted in compartment 422, the cartridge barcode 294 is positioned within the hole 438 and can be viewed by camera 427. The image captured by camera 427 also includes the barcode 120 on the first pouch when it is moved out of the cartridge 200 onto the platform 432 and into the view of the camera 427.

One of skill in the art will recognize that the number, positions and types of sensors may vary depending on a number of factors such as, for example, the method for encoding the data on the pouches, the functionality of the sensors, the available space within the spooler unit for placement of the sensors, pouch packaging, etc. Some non-limiting examples related to these changes are: RFID sensors may be used if the data on each pouch is contained in an RFID tag. Barcode readers may be used in place of cameras to read the barcodes. A single camera may be used to capture the pouch images while loading as well as the pouch and cartridge barcode images during validation. If the material that makes up the top of the pouches is transparent, the image of the pills may be captured from above. Also, the sensors 444 and 450 may be through-beam sensors using any type of light appropriate to the application, as well as may be replaced by another sensor type appropriate for the application.

When a cartridge 200 or cartridge frame 204 is placed in the compartment 422, the spooler 400 may use the roller 430 to advance whatever is being held in place by the brake arm 274, whether that be the starter strip 424 in an empty cartridge frame 204 or the first pouch 112 in a full cartridge. In one embodiment, the starter strip 424 may include an indicator that, when advanced out of the cartridge frame 204 and read by a sensor, specifies to the system that a starter strip is being advanced from an empty cartridge. The indicator may be a barcode, RFID tag, or other marking that can be read by the appropriate sensor. Although the system may expect a full cartridge 200 in some instances (see processes described below), sensing the barcode 120 on a pouch 112, as opposed to an indicator on the starter strip 424, confirms the content. Sensing the indicator on the starter strip 424 confirms to the system that the cartridge frame 204 is empty, and ensures that an appropriate piece was inserted in the compartment 422 for the spooling process.

FIG. 13 illustrates lever 448 that latches the cartridge frame 204 in place within compartment 422. As projection 446 is pushed past it, lever 448 is deflected and then snaps back into place over the projection 446, holding the cartridge frame 204 securely within compartment 422. Lever 448 may be spring-loaded to bias it in the latched position. One of skill in the art will recognize that a latch can be implemented in other forms such as a solenoid sliding a rod or other latching device into place above the projection, or inserting a rod into a hole in the frame to hold it in place.

Figure 15:
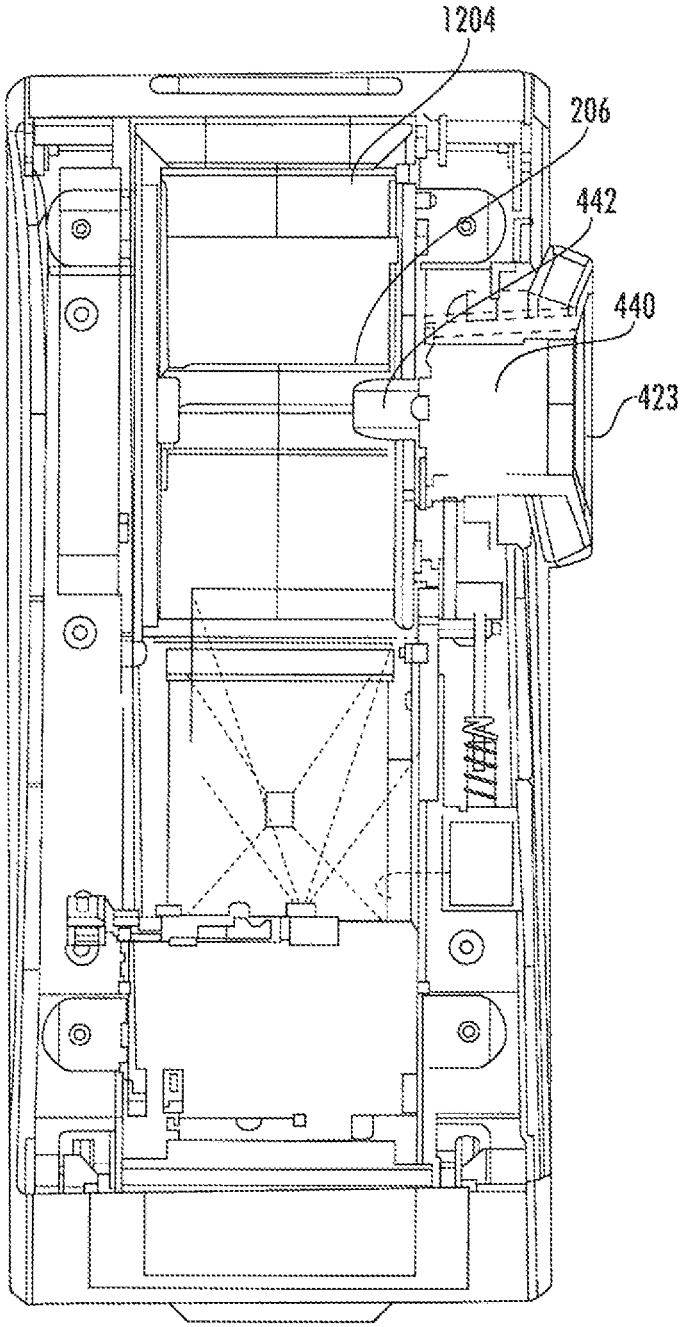
FIG. 15 is a top section view of the spooler of FIG. 11.

Spool drive 440, which is associated with button 423, may be engaged by the user pressing button 423. When engaged, the shaft 442 of drive 440 is inserted in and engages the hub of cylinder 206 (FIG. 15). When the drive 440 is engaged, and the button 423 is again depressed, the shaft 442 is retracted, thereby releasing the cylinder 206 and allowing the cartridge frame 204 or cartridge 200 to be removed from the compartment 422.

Figure 18:
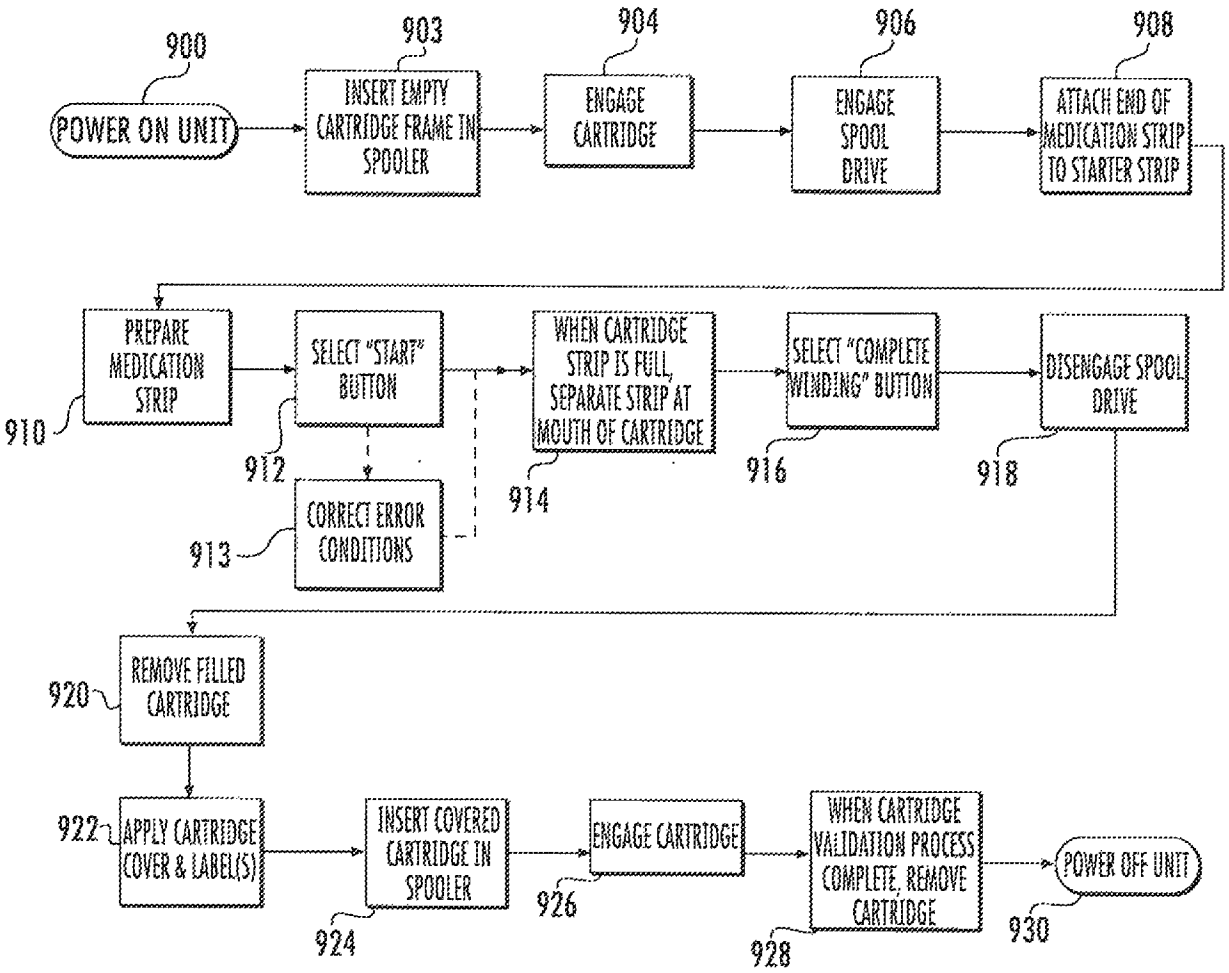
FIG. 18 is a flow chart of the operational flow of the spooler of FIG. 11, according to embodiments of the invention.
Figure 19:
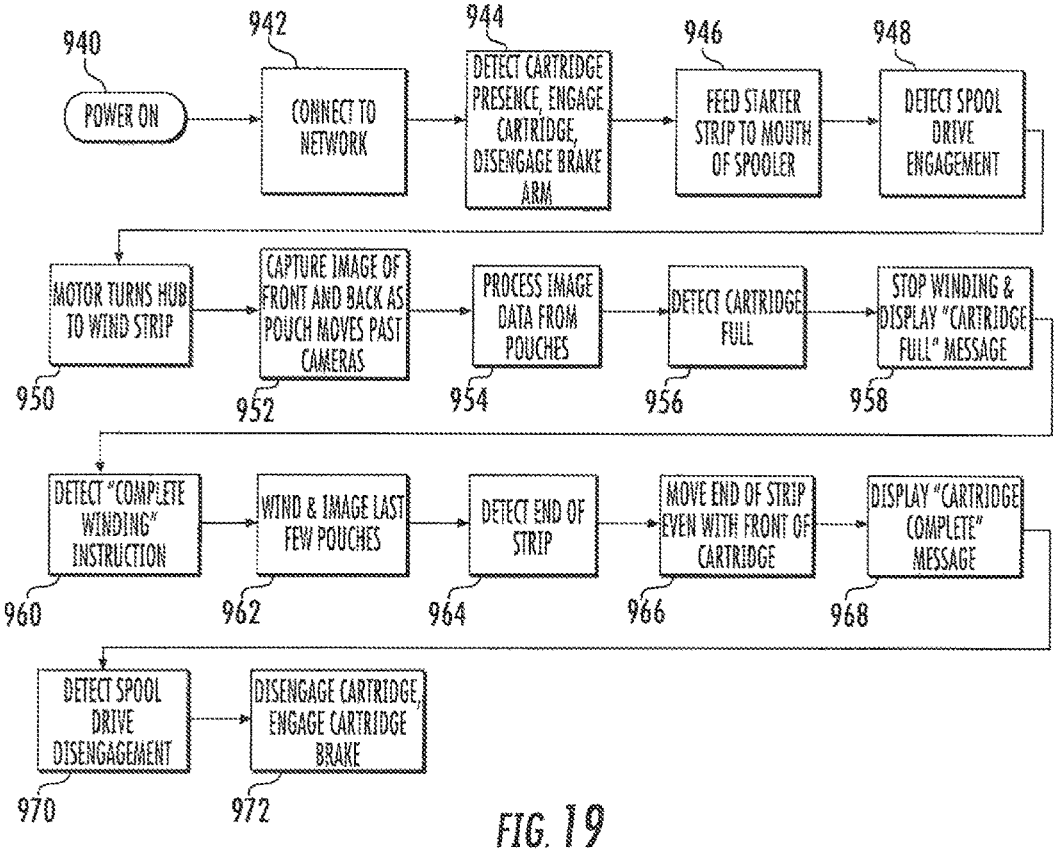
FIG. 19 is a chart of the mechanical flow of the spooler of FIG. 11 during cartridge, loading, according to embodiments of the invention.

Turning now to the process for assembling the cartridge 200. FIG. 18 illustrates the steps that may be taken by the user when using the spooler 400. The user first powers on the spooler unit at step 900 using a power switch (not shown). The user inserts an empty cartridge frame in the empty compartment of the spooler at step 902 and engages the cartridge latch at step 904 by pushing down on the cartridge. The user presses the button to engage the spool drive at step 906. At step 908 the user then attaches the starter strip (which has been made available outside the unit through the slot) to the medication strip that is to be loaded into the cartridge; attachment ran be achieved in any desirable manner such as by tape, glue or other adhesive material, staples, etc. The user then prepares the medication strip at step 910 by straightening and flattening the strip so as to remove any twists, kinks, stacked pills, or other undesirable structure or formation that might interfere with the spooling process and positions the strip so that it will move smoothly into and through the spooler. The user begins the spooling process at step 912 by pressing the start button on the screen display. If any errors are encountered during spooling (i.e., the spooler jams, cannot read barcodes, etc.) then spooling will stop, the user will be notified of the error and required to correct the error conditions at step 913 in order to proceed, which may consist of resuming the process or reinitiating the process, depending on the extent, and nature of the errors. When the cartridge is full, winding is paused and at step 914 the user tears or cuts the strip at the mouth of the spooler. There may be more pouches in the strip than can be accommodated by the cartridge and so the remainder will need to be loaded into a second (or more) cartridge. Alternatively, the winding may pause because the end of the strip has been reached and the cartridge is considered "full", in which case the user does not need to tear the strip or remove any pouches at this step. At step 916, the user selects a button on the display screen instructing the system to complete the winding process. When the process is complete, the user is notified and at step 918 the user disengages the spool drive. At step 920 the user removes the filled cartridge frame and at step 922 applies the cartridge cover and one or more labels to the cartridge cover, if needed. The cartridge cover and/or label is applied so that the cartridge barcode is in the corner nearest the projection on the cartridge frame in this position it is in view of the camera used for validation. The user then inserts the covered cartridge back in the compartment of the spooler at step 924, pressing down on the cartridge and engaging the latch at step 926. When the cartridge validation process is complete, the user is notified and removes the cartridge from the spooler at step 928 and powers off the unit at step 930. FIG. 19 illustrates exemplary system processes for loading the medication strip in the cartridge. At step 940 the system powers on and connects to the network at step 942. As the cartridge is snapped into place, at step 944 the system detects the presence of the cartridge, engages the latch, and disengages the brake arm that is holding the medication strip in place within the cartridge. The brake arm is disengaged by the entry of the roller into the cartridge through the hole in the base. At step 946, the roller turns in a forward direction (toward the front of the spooler device) in order to feed the starter strip to and through the slot of the spooler so that the medication strip can be attached. The system may employ any of a number of mechanisms to determine when to begin feeding the starter strip, including, for example, a sensor to directly monitor the status of the brake, (for example, camera 427 may be positioned to include the brake in its view, or another sensor may be used to monitor the brake position), monitoring the number of steps occurring upon insertion of the cartridge, or allowing a certain amount of time to elapse following cartridge insertion. When the system detects the spool drive engagement at step 948, the motor turns, at step 950 to turn the hub and wind the medication strip around the cylinder. The motor turns at a speed compatible with the ability of the sensors to capture the pouch information and capture images, if desired. In one embodiment, as the pouches pass the cameras, the cameras capture images of the front and back of each individual pouch at step 952. The system then processes the images at step 954 to obtain the data contained therein relative to the pouches, such as, for example, their contents, the patient, or any other information that might be included. If the system encounters a problem at any of these steps (i.e., cannot connect to network; does not detect the cartridge; cannot engage latch or disengage brake arm; cannot feed starter strip through spooler properly; cannot detect spool drive engagement; cannot wind strip due to jamming or problem with the motor; unable to image pouches due to problems with camera(s), pouches or data on the pouches; cannot read image data; etc.) an error message may be displayed and the process halted. The error message may include identification of the problem, steps to take to resolve the problem, instructions on how to proceed when the problem is resolved, contact information for assistance on solving the problem, etc. Once the issue has been rectified, the loading process can be resumed or reinitiated. At step 956 the system detects that the cartridge is full via sensor 444. At step 958 the system stops winding and notifies the user that the cartridge is full so that the user may tear off or cut the pouch at the slot. The system detects selection of the button to complete the winding process at step 960. The motor again turns the cylinder in the forward direction to wind the remaining pouches at step 962, imaging the remaining pouches in the process. If the medication strip is shorter than is required to fill the cartridge, the sensor 450 may detect the end of the strip before the sensor 444 detects that the cylinder is full. In this case, the system will skip steps 956, 958 and 960, and will proceed from step 954 to step 964. In either case, when the end of the strip is detected at step 964, the strip is advanced further into the cartridge at step 966 so that the end of the strip is even with the front of the cartridge. In one embodiment, the advancement of the strip in step 966 is performed by the roller, instead of by further rotation of the cylinder. Using the roller turning in a reverse direction (toward the back of the spooler unit) to move the strip may allow more precise control over the location of the end of the strip to ensure that it is not moved past the brake arm. One of skill in the art will recognize that the placement of the end of the strip may be monitored in any of a number of ways, such as, for example, by a sensor, by monitoring physical rotation of the roller, by allowing the reverse movement to occur only for a specific amount of time, etc. At step 968 the system notifies the user that the cartridge loading is complete. When the system detects that the spool drive has been disengaged at step 970, the latch is disengaged and the cartridge brake arm re-engages with the notch to retain the strip in place at step 972, as the cartridge is separated from the roller.

Figure 20:
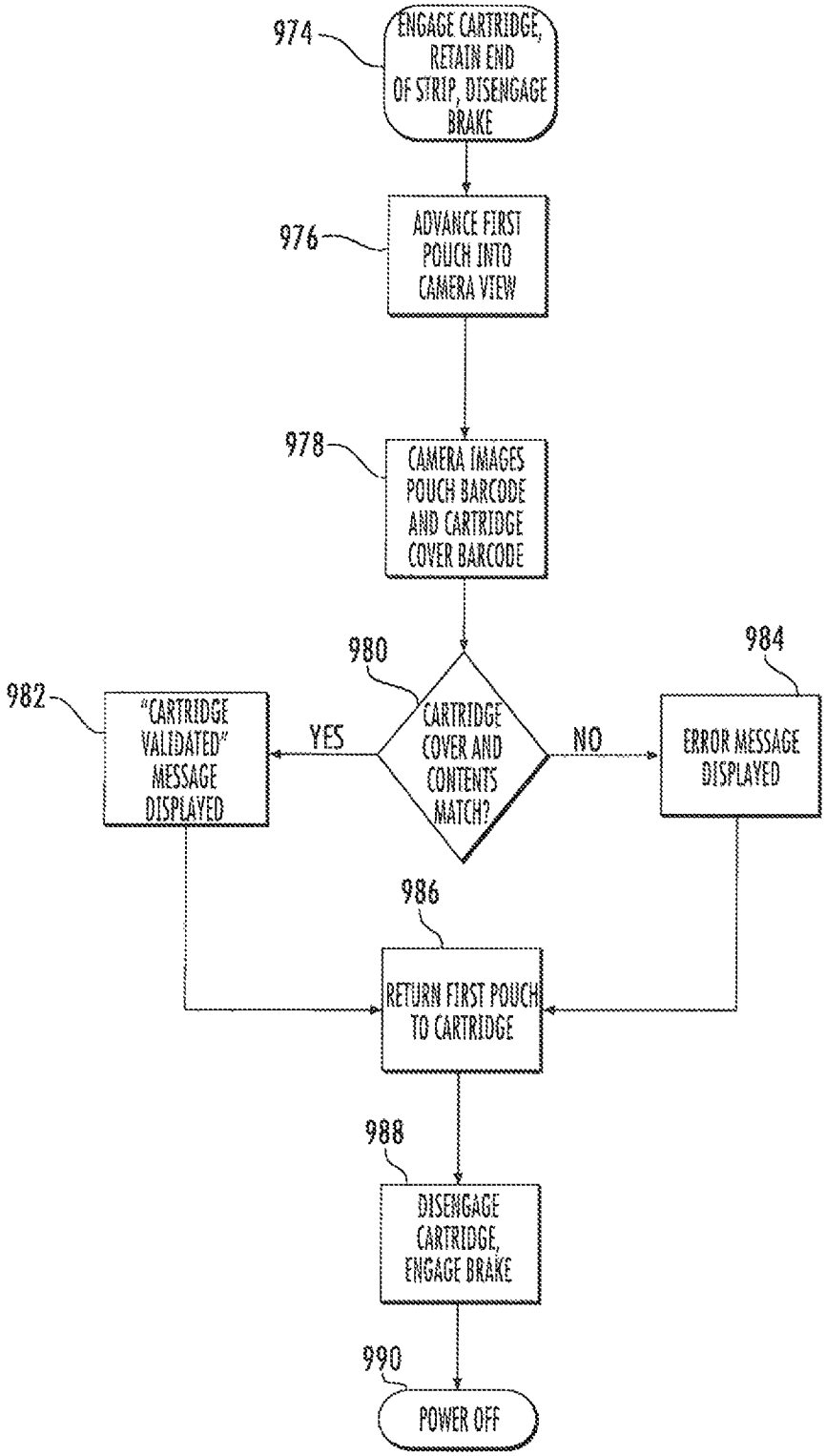
FIG. 20 is a chart of the mechanical flow of the spooler of FIG. 11 during cartridge validation, according to embodiments of the invention.

FIG. 20 illustrates exemplary steps of the system process for cartridge validation. Once the cover and, if applicable, labels have been added to the loaded cartridge frame and the cartridge assembly is complete, the user places the completed cartridge in the spooler compartment. The system engages the latch and the roller disengages the brake and retains the end of the strip at step 974. At step 976, the first pouch is advanced out of the cartridge, toward the front of the spooler device, so that the pouch information is available to a sensor. In one embodiment, the roller, turning in a forward direction (toward the front of the spooler device), is used to move the first pouch, out of the cartridge. At step 978, the information on both the first pouch and the cartridge is read by one or more sensors. In one embodiment, the sensor is a camera; a camera may be positioned so that it can image both the pouch and cartridge barcodes in one image. At step 980, the system cheeks whether the information read from the pouch barcode matches the information read from the cartridge barcode. The matching information may include, but not be limited to, patient name, patient number, prescription numbers, dates for administration of medication, etc. If the information from the barcodes matches, the system displays a message that the validation has been successful at step 982. If the information does not match, the system displays an error message at step 984. In either case, the system returns the first pouch to the cartridge at step 986. In one embodiment, the roller, turning in the reverse direction (toward the back of the spooler device), is used to move the pouch into position just inside the cartridge. One of skill in the art will recognize that the placement of the end of the strip may be monitored in any of a number of ways, as discussed above. At step 988 the system disengages the latch. As the cartridge is released from its interaction with the roller, the brake arm is re-engaged to hold the strip in place. The system powers off at step 990.

Figure 18A:
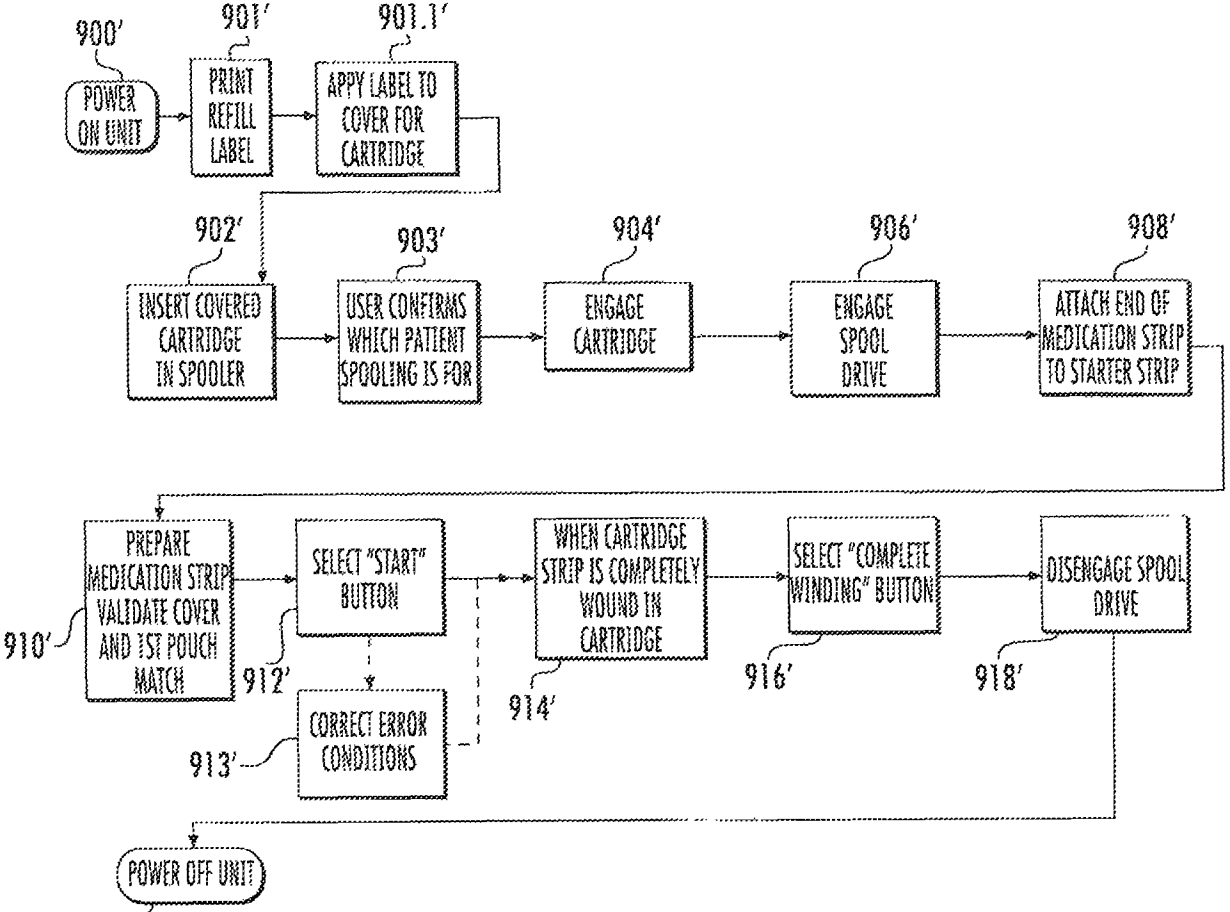
FIG. 18A is a flow chart of the operational flow of the spooler of FIG. 1, according to alternative embodiments of the invention.

One of skill in the art will recognize that variations on the steps enumerated above still fall within the scope of the invention. As a non-limiting example, if the cartridge cover includes a hole so that the spool drive could access the cylinder hub with the cover on the cartridge, the cover and label(s) may be applied to the empty cartridge before it is inserted into the spooler compartment to be loaded with the medication strip. This method is illustrated in FIG. 18A. The user first powers on the spooler unit at step 900' using a power switch. A refill label is printed (step 901') and applied to the cover of the cartridge (step 901.1'). The user inserts the covered cartridge in the empty compartment of the spooler at step 902', confirms the patient's identity at step 903', and engages the cartridge latch at step 904' by pushing down on the cartridge. The user presses the button to engage the spool drive at step 906'. At step 908' the user then attaches the starter to the medication strip that is to be loaded into the cartridge. The user then prepares the medication strip at step 910' as described above and validates the color and matches the first pouch. The user initiates the spooling process at step 912' by pressing the start button on the screen display. As above, if any errors are encountered during spooling, then spooling will stop, the user will be notified of the error and required to correct the error conditions at step 913' in order to proceed. When the cartridge is full, winding is paused and at step 914' the user tears or cuts the strip at the mouth of the spooler. At step 916', the user selects a button on the display screen instructing the system to complete the winding process. When the process is complete, the user is notified and at step 918' the user disengages the spool drive and powers off the unit at step 930'. Thus, in this embodiment, steps 920-928 of FIG. 18 would not occur. Also, step 962 of FIG. 19 would skip directly to step 976 of FIG. 20, and step 978 then would read "Camera images last pouch barcode and cartridge cover barcode". In this case, "last pouch" is referring to the same pouch as "first pouch" in step 576—the designation of "first" or "last" resets only to the timing with which the pouch is accessed. Alternatively, in this case, or as an additional validation step, the system might perform the validation with any pouch in the strip, since the cartridge barcode would be available throughout the process.

The present invention has been described herein with reference to flowchart and/or block diagram illustrations of methods, systems, and devices in accordance with exemplary embodiments of the invention. It will be understood that each block of the flowchart and/or block diagram illustrations, and combinations of blocks in the flowchart and/or block diagram illustrations, may be implemented by computer program instructions and/or hardware operations. These computer program instructions may be provided to a processor of a general purpose computer, a special purpose computer, or other programmable data processing apparatus to produce a machine, such that the instructions, which execute via the processor of the computer or other programmable data processing apparatus, create means for implementing the functions specified in the flowchart and/or block diagram block or blocks.

These computer program instructions may also be stored in a computer usable or computer-readable memory that may direct a computer or other programmable data processing apparatus to function in a particular manner, such that the instructions stored in the computer usable or computer-readable memory produce an article of manufacture including instructions that implement the function specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart and/or block diagram block or blocks.

It will be further appreciated that the functionality of any or all of the program modules may also be implemented using discrete hardware components, one or more application specific integrated circuits (ASICs), or a programmed digital signal processor or microcontroller. The program code may execute entirely on a single processor and/or across multiple processors, as a stand-alone software package or as part of another software package. The program code may execute entirely on an electronic device or only partly on the electronic device and partly on another device. In the latter scenario, the other device may be connected to the electronic device through a wired and/or wireless local area network (LAN) and/or wide area network (WAN), or the connection may be made, to an external computer (for example, through the Internet using an Internet Service Provider).

The above examples are merely illustrative of the many applications of the system of present invention. Although only a few embodiments of the present invention have been described herein, it should be understood that the present invention might be embodied in many other specific forms without departing from the spirit or scope of the invention. Therefore, the present examples and embodiments are to be considered as illustrative and not restrictive, and the invention may be modified within the scope of the appended claims.

We claim:

1. A system for preparing medication cartridges for use with a pharmaceutical dispensing system, comprising:

a device for loading a medication strip into a cartridge for the pharmaceutical dispensing system, comprising:

a housing with an opening, the housing having an internal compartment and a slot;

a first drive unit mounted in the housing for turning a cylinder within the cartridge; and a second drive unit mounted in the housing wherein operation of the second drive unit conveys the medication strip along a path between the cylinder and the slot through direct interaction with the medication strip; and a cartridge comprising:

a frame with:

opposed sidewalls and a cylinder disposed between the sidewalls, a floor and a base, the floor positioned above the base and including a routing hole, an opening between the floor and the base at an end opposite the routing hole;

a starter strip attached to the cylinder and passing through the routing hole toward the opening; and wherein, when the cartridge is inserted in the compartment of the device, the starter strip is routed through the opening in the cartridge, out of the device housing through the slot such that a strip of medication pouches can be attached to the starter strip for spooling around the cylinder.

2. The system of claim 1 wherein the cartridge is inserted into the device through the opening in the housing and into the compartment of the housing.

3. The system of claim 1, wherein the device comprises one or more sensors.

4. The system of claim 3 wherein the one or more sensors are cameras.

5. The system of claim 4, wherein the device further comprises a platform over which the medication strip is conveyed by the second drive unit.

6. The system of claim 5, wherein the platform contains a window.

7. The system of claim 5, wherein at least one of the cameras is positioned above the platform.

8. The system of claim 6, wherein at least one of the cameras is positioned below the platform.

9. A method of loading a cartridge for use in a pharmaceutical dispensing system comprising the steps of:

(a) providing a cartridge comprising:

a frame with:

opposed sidewalls and a cylinder disposed between the sidewalls, a floor and a base, the floor positioned above the base and including a routing hole, an opening between the floor and the base at an end opposite the routing hole;

(b) providing a plurality of individually sealed pouches of pharmaceuticals to be loaded in the cartridge, the pouches formed as an elongate strip and containing information on the pouches;

(c) providing, a spooler device comprising:

a housing with an opening, an internal compartment and a slot;

a first drive unit mounted in the housing to engage the cartridge cylinder;

a second drive unit mounted in the housing to engage the strip of pouches;

one or more sensors for reading pouch and cartridge information;

(d) inserting the cartridge into the housing through the opening in the housing and into the compartment of the housing;

(e) introducing the strip of pouches into the spooler device through the slot;

(f) using the first drive unit, wrapping the strip of pouches around the cylinder of the cartridge; and (g) using the second drive unit, positioning an end of the strip of pouches near the opening in the cartridge.

10. The method of claim 9 wherein:

the cartridge includes a starter strip attached to the cylinder and the starter strip is fed out of the slot of the spooler device; and introducing the strip of pouches into the spooler device through the slot includes attaching the strip of pouches to the starter strip.

11. The method of claim 9, further comprising the steps of:

(a) removing the loaded cartridge from the spooler device;

(b) applying a cover to the cartridge frame;

(c) applying one or more labels to the cover that contain information about contents of the cartridge;

(d) inserting the covered cartridge into the housing of the spooler device through the opening in the housing and into the compartment of the housing; and (e) using the sensors in the spooler device, validating that the information on the cartridge cover matches the information on the pouches in the cartridge.

12. The method of claim 11 additionally comprising the steps of:

using the second drive unit to advance the first pouch out of the cartridge through the opening between the floor and base so that the pouch information can be viewed by the sensor(s), and using the second drive unit to move the first pouch back into position inside the cartridge near the opening when the validation step is complete.

13. The method of claim 11, wherein a single sensor captures both the information on the cartridge cover and the information on the pouches.

14. The method of claim 9, wherein the cartridge further comprises a cover and the cover contains information about contents of the cartridge.

15. The method of claim 14, further comprising the step of:

using the sensors in the spooler device, validating that the information on the cartridge cover matches the information on the pouches in the cartridge.

16. The method of claim 15, wherein the validating step occurs as the first drive unit is wrapping the strip of pouches around the cylinder of the cartridge frame or as the second drive unit positions the end of the strip of pouches near the opening in the cartridge.

17. The method of claim 15, wherein a single sensor captures both the information on the cartridge cover and the information on the pouches.

* * * * *